US005743724A

United States Patent [19]

Mifune et al.

[11] Patent Number: 5,743,724

[45] Date of Patent: Apr. 28, 1998

[54] FLAME REACTION MEMBER FOR GAS COMBUSTION APPLIANCES AND A PROCESS FOR PRODUCING THE SAME

[75] Inventors: Hideo Mifune; Masato Seki; Jun Kashiwagi; Satosi Komiyama, all of Shizuoka-ken, Japan

[73] Assignee: Tokai Corporation, Shizuoka-ken, Japan

[21] Appl. No.: 555,997

[22] Filed: Nov. 15, 1995

[30] Foreign Application Priority Data

| | | | |
|---|---|---|---|
| Nov. 16, 1994 | [JP] | Japan | 6-281900 |
| Nov. 22, 1994 | [JP] | Japan | 6-288244 |
| Dec. 5, 1994 | [JP] | Japan | 6-300984 |

[51] Int. Cl.[6] ..... F23Q 2/34

[52] U.S. Cl. ..... 431/126; 431/4

[58] Field of Search ..... 431/126, 125, 431/4

[56] References Cited

U.S. PATENT DOCUMENTS

| | | | |
|---|---|---|---|
| D. 103,216 | 2/1937 | Cevasco | D6/601 |
| D. 206,747 | 1/1967 | Essman | D6/601 |
| D. 292,451 | 10/1987 | Jorgensen | D6/333 |
| 3,721,434 | 3/1973 | Spies | 5/655 |
| 4,472,135 | 9/1984 | Parker et al. | 431/126 |
| 4,941,818 | 7/1990 | Ohe et al. | 431/268 |
| 4,992,041 | 2/1991 | Kewish . | |

FOREIGN PATENT DOCUMENTS

| | | | |
|---|---|---|---|
| 2690976 | 11/1993 | France | 431/126 |
| 59-8050 | 1/1984 | Japan . | |
| 3-13718 | 1/1991 | Japan . | |
| 405141653 | 6/1993 | Japan | 431/268 |

OTHER PUBLICATIONS

British Search report dated Jan. 16, 1996 in Application No. GB 9523373.0.

*Primary Examiner*—Carl D. Price
*Attorney, Agent, or Firm*—Baker & Botts

[57] ABSTRACT

A flame reaction member for gas combustion appliances comprises a flame reaction material, which is to be heated by a gas flame having been produced by a gas combustion appliance and which undergoes a flame reaction and colors the gas flame by the flame reaction. The flame reaction material comprises a glass compound, which is formed by mixing a flame reaction agent and a fused material with each other and fusing them together. The flame reaction agent is constituted of an oxide or a salt of a metal capable of undergoing the flame reaction. The fused material is capable of being mixed and fused together with the flame reaction agent and vitrified.

24 Claims, 19 Drawing Sheets

FLAME REACTION MEMBER FOR GAS COMBUSTION APPLIANCES AND A PROCESS FOR PRODUCING THE SAME

BACKGROUND OF THE INVENTION

1. Field of the Invention

This invention relates to a flame reaction member, which is to be located in a gas combustion appliance, such as a gas lighter for smoker's requisites, a lighter, or a torch, and which undergoes a flame reaction and colors a gas flame produced by gas combustion with a burner, or the like, of the gas combustion appliance. This invention also relates to a process for producing the flame reaction member for gas combustion appliances.

2. Description of the Prior Art

In combustion appliances, such as candles, lighters, and torches, combustion flames have heretofore been often colored with flame reaction materials. The coloring of combustion flames is effective to enhance the aesthetic and decorative values of the combustion flames. Also, it is effective for safety to impart a color to colorless combustion flames such that they can be identified.

Flame reactions with the flame reaction materials utilize a phenomenon such that, when salts of alkali metals, alkaline earth metals, and the like, are heated heavily in flames generated by burners, colors inherent to the respective metals can be formed in the flames. In order to color combustion flames, salts of metal elements capable of forming required flame colors may be interposed in the combustion flames.

For example, in order to color the flames produced by candles, a metal stearate serving as a flame reaction material is mixed into a wax material. During the combustion of the candle, simultaneously with the volatilization of the molten wax material, the flame reaction material is volatilized and is caused to form a color by being heated in the flame.

In order to color the flames produced by other combustion appliances, an aqueous solution of a water-soluble inorganic salt is sprayed into the flame. Alternatively, a carrier is impregnated with an aqueous solution of a water-soluble inorganic salt, dried, and then located at a high temperature portion of the flame. In particular, in the cases of gas lighters, a coiled nichrome wire having been coated with a flame reaction material is located in the vicinity of the fire outlet of the gas lighter, and a colored flame is thereby obtained.

Also, a process for producing a flame reaction member has theretofore been known, wherein a flame reaction material containing a flame reaction agent is adhered to a wire-shaped substrate by dipping, or the like, the substrate, to which the flame reaction material has been adhered, is heated, a binder, or the like, contained in the flame reaction material is thereby burned off, and the substrate is baked such that the flame reaction material may be supported on the substrate.

However, it has heretofore been difficult to obtain a flame reaction member for coloring a flame by utilizing a flame reaction as described above, which member can steadily undergo the flame reaction in order to provide a stable colored flame and has a good heat durability with respect to repeated combustion and has a long service life in a gas combustion appliances provided with burners wherein primary air is mixed into a fuel gas.

Specifically, a wire-shaped substrate is dipped in a viscous liquid-like flame reaction material comprising a flame reaction agent, which is prepared by mixing a salt of an alkali metal, an alkaline earth metal, or the like, capable of undergoing a flame reaction, and a binder, or the like. The flame reaction material is thereby adhered to the substrate. The substrate, to which the flame reaction material has been adhered, is then baked, and a flame reaction member is thereby formed. The flame reaction member is located at a fire outlet of a gas combustion appliance, such as a gas lighter. In such cases, the problems occur in that, if the flame reaction material is chemically unstable, it will deteriorate when being left to stand for a long period of time, and a desired flame reaction cannot be obtained any more. Also, if the heat-resistance strength is low, the flame reaction material will crack due to rapid heating and quenching cycles due to lighting and extinguishment during the use, the cracked portions will come off the substrate, and therefore several portions of the flame cannot be colored.

Also, when a flame reaction material colors a flame, the flame reaction metal is scattered in the flame and exhausted due to heating with the gas flame. Therefore, the problems occur in that, as the flame reaction material is used, the amount of the flame reaction metal scattered becomes small, and the formed color becomes unstable or pale. Thus the flame reaction material cannot be used repeatedly or for a long time, and its service life is short. Further, depending upon the composition of the flame reaction material, the problems occur in that the activity of the flame reaction is low, and therefore a long time is required from the heating to the color formation. In particular, in the cases of gas lighters, it is necessary that the time required to light a fuel gas is short, and that the time required from the lighting to the occurrence of the color formation of the flame with the flame reaction is as short as possible. Furthermore, a good durability with respect to repeated heating and quenching is required.

Moreover, as the characteristics of the flame reaction material, it is required that the flame reaction material is firmly supported on the substrate, that the flame reaction material is chemically stable and does not deteriorate even when being left to stand for a long period of time in air, and that the flame reaction material undergoes little exhaustion during the repeated use, remains on the substrate continuously to always undergo the flame reaction, and thus has a long service life.

SUMMARY OF THE INVENTION

The primary object of the present invention is to provide a flame reaction member for gas combustion appliances, which has good color forming characteristics and a good durability, and a process for producing the flame reaction member for gas combustion appliances.

Another object of the present invention is to provide a flame reaction member for gas combustion appliances, which is capable of undergoing a flame reaction for forming a blue-green color, and which has good color forming characteristics and a good durability, and a process for producing the flame reaction member for gas combustion appliances.

A further object of the present invention is to provide a flame reaction member for gas combustion appliances, which is capable of undergoing a flame reaction for forming a crimson-red color, and which has good color forming characteristics and a good durability, and a process for producing the flame reaction member for gas combustion appliances.

The present invention provides a first flame reaction member for gas combustion appliances, comprising a flame reaction material, which is to be heated by a gas flame having been produced by a gas combustion appliance and which undergoes a flame reaction and colors the gas flame by the flame reaction, wherein the flame reaction material comprises a glass compound, which is formed by mixing a flame reaction agent and a fused material with each other and fusing them together, the flame reaction agent being constituted of an oxide or a salt of a metal capable of undergoing the flame reaction, the fused material being capable of being mixed and fused together with the flame reaction agent and vitrified.

The flame reaction agent is constituted of an oxide or a salt of a metal, such as an alkali metal or an alkaline earth metal, which is capable of undergoing a flame reaction. For example, in cases where a blue-green gas flame is to be obtained, CuO is employed as the flame reaction agent. In cases where a crimson-red gas flame is to be obtained, $Li_2CO_3$ is employed as the flame reaction agent. In cases where the flame color is to be varied from an orange color to a crimson color, a mixture of $ZrO_2$ and $Li_2CO_3$ is employed as the flame reaction agent. Various other flame colors can be obtained by selecting an oxide or a salt of a metal element in accordance with the desired flame color.

The fused material should preferably be constituted of a mixture of an oxide or a salt, which is other than the flame reaction agent, and a low-fused glass material. Alternatively, the fused material may be constituted of only the oxide or the salt without the low-fused glass material being mixed. As another alternative, the fused material may be constituted of only the low-fused glass material. As the oxide or the salt other than the flame reaction agent, at least one of $B_2O_3$, $Al_2O_3$, $SiO_2$, and $ZrO_2$ should preferably be employed. Also, the low-fused glass material should preferably be constituted of $SiO_2$, $B_2O_3$, and $ZnO_2$.

In order to form the first flame reaction member in accordance with the present invention, the flame reaction material comprising the glass compound, which is constituted of the flame reaction agent and the fused material, should preferably be fusion bonded to a substrate. One of appropriate substrates is a wire material constituted of a nickel-chrome alloy, which has a high heat-resistance strength.

The present invention also provides a first process for producing a flame reaction member for gas combustion appliances, comprising the steps of:

i) mixing a flame reaction agent and a fused material with each other, the flame reaction agent being constituted of an oxide or a salt of a metal capable of undergoing a flame reaction, the fused material being constituted of an oxide or a salt capable of being mixed and fused together with the flame reaction agent and vitrified, ii) processing the resulting mixture in order to obtain a viscous liquid-like mixed material, iii) applying the viscous liquid-like mixed material onto a substrate, and iv) heating the mixed material, which has been applied onto the substrate, to a temperature equal to at least a melting point of the mixed material, a flame reaction material, which comprises the resulting molten glass compound, being thereby fusion bonded to the substrate.

In a preferable aspect of the first process for producing a flame reaction member for gas combustion appliances in accordance with the present invention, the mixed material is blended with a binder and worked up into the viscous liquid, and is thereafter applied to the substrate. In such cases, pre-heating treatment for removing the binder is carried out before the mixed material is heated to a temperature not lower than the melting point of the mixed material.

In the present invention, by way of example, water or a mixture of a binding compound and water may be employed as the binder.

The present invention further provides a second flame reaction member for gas combustion appliances, comprising a flame reaction material, which is to be heated by a gas flame having been produced by a gas combustion appliance and which undergoes a flame reaction and gives a blue-green color to the gas flame by the flame reaction, wherein the flame reaction material comprises a compound, which is formed by mixing a flame reaction agent and a fused material with each other and fusing them together, the flame reaction agent being constituted of CuO, the fused material containing $B_2O_3$ and a low-fused glass material, which are capable of being mixed and fused together with the flame reaction agent and vitrified.

In the second flame reaction member for gas combustion appliances in accordance with the present invention, the fused material should preferably further contain $Al_2O_3$. Also, the low-fused glass material should preferably be composed of $SiO_2$, $B_2O_3$, and ZnO, and should more preferably be composed of 10% of $SiO_2$, 25% of $B_2O_3$, and 65% of ZnO. Further, the mixing proportion of the low-fused glass material should preferably fall within the range of 20% to 40% by weight with respect to the CuO—$B_2O_3$—$Al_2O_3$ ternary material.

In the aforesaid CuO—$B_2O_3$—$Al_2O_3$ ternary material, the blending proportions of CuO, $B_2O_3$, and $Al_2O_3$ should preferably fall within the range surrounded by a point A (CuO: 10%, $B_2O_3$: 90%, $Al_2O_3$: 0%), a point B (CuO: 10%, $B_2O_3$: 70%, $Al_2O_3$: 20%), a point C (CuO: 20%, $B_2O_3$: 50%, $Al_2O_3$: 30%), a point D (CuO: 50%, $B_2O_3$: 20%, $Al_2O_3$: 30%), a point E (CuO: 65%, $B_2O_3$: 20%, $Al_2O_3$: 15%), a point F (CuO: 65%, $B_2O_3$: 25%, $Al_2O_3$: 10%), and a point G (CuO: 50%, $B_2O_3$: 50%, $Al_2O_3$: 0%) as illustrated in the accompanying FIG. 10.

In order to form the second flame reaction member in accordance with the present invention, the flame reaction material comprising the compound, which is constituted of the flame reaction agent and the fused material, should preferably be fusion bonded to a substrate. One of appropriate substrates is a wire material constituted of a nickel-chrome alloy, which has a high heat-resistance strength.

The present invention still further provides a second process for producing a flame reaction member for gas combustion appliances, comprising the steps of:

i) mixing a flame reaction agent and a fused material with each other, the flame reaction agent being constituted of CuO, the fused material containing $B_2O_3$ and a low-fused glass material, which are capable of being mixed and fused together with the flame reaction agent and vitrified, ii) processing the resulting mixture in order to obtain a viscous liquid-like mixed material, iii) applying the viscous liquid-like mixed material onto a substrate, and iv) heating the mixed material, which has been applied onto the substrate, to a temperature equal to at least a melting point of the mixed material, a flame reaction material, which comprises the resulting molten compound, being thereby fusion bonded to the substrate.

In a preferable aspect of the second process for producing a flame reaction member for gas combustion appliances in accordance with the present invention, the mixed material is blended with a binder and worked up into the viscous liquid, and is thereafter applied to the substrate. In such cases, pre-heating treatment for removing the binder is carried out before the mixed material is heated to a temperature not lower than the melting point of the mixed material.

The present invention also provides a third flame reaction member for gas combustion appliances, comprising a flame reaction material, which is to be heated by a gas flame having been produced by a gas combustion appliance and which undergoes a flame reaction and gives a crimson-red color to the gas flame by the flame reaction, wherein the flame reaction material comprises a compound, which is formed by mixing a flame reaction agent and a fused material with each other and fusing them together, the flame reaction agent being constituted of $Li_2CO_3$, the fused material containing $SiO_2$ and a low-fused glass material, which are capable of being mixed and fused together with the flame reaction agent and vitrified.

In the third flame reaction member for gas combustion appliances in accordance with the present invention, the fused material should preferably further contain $Al_2O_3$. Also, the low-fused glass material should preferably be composed of $SiO_2$, $B_2O_3$, and ZnO, and should more preferably be composed of 10% of $SiO_2$, 25% of $B_2O_3$, and 65% of ZnO. Further, the mixing proportion of the low-fused glass material should preferably fall within the range of 10% to 60% by weight with respect to the $Li_2CO_3$—$SiO_2$—$Al_2O_3$ ternary material, and should more preferably fall within the range of 20% to 50% by weight with respect to the $Li_2CO_3$—$SiO_2$—$Al_2O_3$ ternary material.

In the aforesaid $Li_2CO_3$—$SiO_2$—$Al_2O_3$ ternary material, the blending proportions of $Li_2CO_3$, $SiO_2$, and $Al_2O_3$ should preferably fall within the range surrounded by a point A ($Li_2CO_3$: 25%, $SiO_2$: 75%, $Al_2O_3$: 0%), a point B ($Li_2CO_3$: 30%, $SiO_2$: 40%, $Al_2O_3$: 30%), a point C ($Li_2CO_3$: 40%, $SiO_2$: 20%, $Al_2O_3$: 40%), a point D ($Li_2CO_3$: 55%, $SiO_2$: 20%, $Al_2O_3$: 25%), and a point E ($Li_2CO_3$: 60%, $SiO_2$: 40%, $Al_2O_3$: 0%) as illustrated in the accompanying FIG. 20.

In order to form the third flame reaction member in accordance with the present invention, the flame reaction material comprising the compound, which is constituted of the flame reaction agent and the fused material, should preferably be fusion bonded to a substrate. One of appropriate substrates is a wire material constituted of a nickel-chrome alloy, which has a high heat-resistance strength.

The present invention further provides a third process for producing a flame reaction member for gas combustion appliances, comprising the steps of:

i) mixing a flame reaction agent and a fused material with each other, the flame reaction agent being constituted of $Li_2CO_3$, the fused material containing $SiO_2$ and a low-fused glass material, which are capable of being mixed and fused together with the flame reaction agent and vitrified, ii) processing the resulting mixture in order to obtain a viscous liquid-like mixed material, iii) applying the viscous liquid-like mixed material onto a substrate, and iv) heating the mixed material, which has been applied onto the substrate, to a temperature equal to at least a melting point of the mixed material, a flame reaction material, which comprises the resulting molten compound, being thereby fusion bonded to the substrate.

In a preferable aspect of the third process for producing a flame reaction member for gas combustion appliances in accordance with the present invention, the mixed material is blended with a binder and worked up into the viscous liquid, and is thereafter applied to the substrate. In such cases, pre-heating treatment for removing the binder is carried out before the mixed material is heated to a temperature not lower than the melting point of the mixed material.

With the first flame reaction member for gas combustion appliances in accordance with the present invention, the flame reaction material comprises the glass compound, which is formed by mixing the flame reaction agent and the fused material with each other and fusing them together. The flame reaction material has been vitrified. Therefore, the first flame reaction member for gas combustion appliances in accordance with the present invention has stable chemical properties and is not susceptible to adverse effects of moisture, or the like. Accordingly, the first flame reaction member for gas combustion appliances in accordance with the present invention can steadily undergo the flame reaction, can provide stable color formation, and has a good durability.

In cases where the fused material is constituted of the mixture of the oxide or the salt, which is other than the flame reaction agent, and the low-fused glass material, the flame reaction and the chemical properties can be stabilized, a high heat-resistance strength, a high mechanical strength, a high fusion bonding strength to the substrate, and good durability can be obtained. Also, because of the low melting point, the color formation with the flame reaction member can be obtained easily.

With the first process for producing a flame reaction member for gas combustion appliances in accordance with the present invention, the flame reaction agent and the fused material are mixed with each other. The resulting mixture is further processed, and the viscous liquid-like mixed material is thereby obtained. The viscous liquid-like mixed material is then applied onto the substrate and heated. The flame reaction material, which comprises the resulting molten glass compound, is thereby fusion bonded to the substrate. In this manner, the flame reaction member can be produced with the simple steps. Also, the molten glass compound takes on the form of a spherical shape due to its surface tension and can be appropriately fusion bonded to the substrate.

The color formation with the flame reaction material of the first flame reaction member for gas combustion appliances in accordance with the present invention occurs in the manner described below. Specifically, when the flame reaction material is heated by the gas flame, which is produced in an approximately colorless state by the combustion with air being mixed into the gas, the heated glass compound is molten, and the metal oxide serving as the flame reaction agent is subjected to a reduction reaction in the reducing flame. The metal atoms resulting from the reduction reaction are scattered into the flame, moved therein, and further heated in the high-temperature combustion flame, which is being produced by the high-temperature combustion of the gas with air being mixed in. As a result, a line spectrum occurs, and the gas flame is thus colored.

With the second flame reaction member for gas combustion appliances in accordance with the present invention, the flame reaction material comprises the compound, which is formed by mixing the flame reaction agent and the fused material with each other and fusing them together, the flame reaction agent being constituted of CuO, the fused material containing $B_2O_3$ and the low-fused glass material. The flame reaction material has been vitrified. Therefore, the second flame reaction member for gas combustion appliances in accordance with the present invention has stable chemical properties and is not susceptible to adverse effects of moisture, or the like. Accordingly, the second flame reaction member for gas combustion appliances in accordance with the present invention can steadily undergo the flame reaction, can provide stable blue-green color formation, and has a good durability.

In cases where the fused material further contains $Al_2O_3$, particularly in cases where the fused material contains the low-fused glass material, which is composed of $SiO_2$, $B_2O_3$, and ZnO, and the blending proportion of the low-fused glass material and the blending proportions of $CuO—B_2O_3—Al_2O_3$ respectively fall within the ranges described above, the blue-green color flame reaction and the chemical properties can be stabilized, a high heat-resistance strength, a high mechanical strength, a high fusion bonding strength to the substrate, and good durability can be obtained. Also, because of the low melting point, the color formation with the flame reaction member can be obtained easily.

With the second process for producing a flame reaction member for gas combustion appliances in accordance with the present invention, the flame reaction agent and the fused material are mixed with each other, the flame reaction agent being constituted of CuO, the fused material containing $B_2O_3$ and the low-fused glass material. The resulting mixture is further processed, and the viscous liquid-like mixed material is thereby obtained. The viscous liquid-like mixed material is then applied onto the substrate and heated. The flame reaction material, which comprises the resulting molten compound, is thereby fusion bonded to the substrate. In this manner, the flame reaction member can be produced with the simple steps. Also, the molten compound takes on the form of a spherical shape due to its surface tension and can be appropriately fusion bonded to the substrate.

The color formation with the flame reaction material of the second flame reaction member for gas combustion appliances in accordance with the present invention occurs in the manner described below. Specifically, when the flame reaction material is heated by the gas flame, which is produced in an approximately colorless state by the combustion with air being mixed into the gas, the heated compound is molten, and CuO, which is the metal oxide serving as the flame reaction agent, is subjected to a reduction reaction in the reducing flame. The Cu metal atoms resulting from the reduction reaction are scattered into the flame, moved therein, and further heated in the high-temperature combustion flame, which is being produced by the high-temperature combustion of the gas with air being mixed in. As a result, a line spectrum occurs, and the blue-green color is formed in the gas flame.

With the third flame reaction member for gas combustion appliances in accordance with the present invention, the flame reaction material comprises the compound, which is formed by mixing the flame reaction agent and the fused material with each other and fusing them together, the flame reaction agent being constituted of $Li_2CO_3$, the fused material containing $SiO_2$ and the low-fused glass material. The, flame reaction material has been vitrified. Therefore, the third flame reaction member for gas combustion appliances in accordance with the present invention has stable chemical properties and is not susceptible to adverse effects of moisture, or the like. Accordingly, the third flame reaction member for gas combustion appliances in accordance with the present invention can steadily undergo the flame reaction, can provide stable crimson-red color formation, and has a good durability.

In cases where the fused material further contains $Al_2O_3$, particularly in cases where the fused material contains the low-fused glass material, which is composed of $SiO_2$, $B_2O_3$, and ZnO, and the blending proportion of the low-fused glass material and the blending proportions of $Li_2CO_3—SiO_2—Al_2O_3$ respectively fall within the ranges described above, the crimson-red color flame reaction and the chemical properties can be stabilized, a high heat-resistance strength, a high mechanical strength, a high fusion bonding strength to the substrate, and good durability can be obtained. Also, because of the low melting point, the color formation with the flame reaction member can be obtained easily.

With the third process for producing a flame reaction member for gas combustion appliances in accordance with the present invention, the flame reaction agent and the fused material are mixed with each other, the flame reaction agent being constituted of $Li_2CO_3$, the fused material containing $SiO_2$ and the low-fused glass material. The resulting mixture is further processed, and the viscous liquid-like mixed material is thereby obtained. The viscous liquid-like mixed material is then applied onto the substrate and heated. The flame reaction material, which comprises the resulting molten compound, is thereby fusion bonded to the substrate. In this manner, the flame reaction member can be produced with the simple steps. Also, the molten compound takes on the form of a spherical shape due to its surface tension and can be appropriately fusion bonded to the substrate.

The color formation with the flame reaction material of the third flame reaction member for gas combustion appliances in accordance with the present invention occurs in the manner described below. Specifically, when the flame reaction material is heated by the gas flame, which is produced in an approximately colorless state by the combustion with air being mixed into the gas, the heated compound is molten, and $Li_2CO_3$, which is the metal salt serving as the flame reaction agent, is subjected to a reduction reaction in the reducing flame. The Li metal atoms resulting from the reduction reaction are scattered into the flame, moved therein, and further heated in the high-temperature combustion flame, which is being produced by the high-temperature combustion of the gas with air being mixed in. As a result, a line spectrum occurs, and the crimson-red color is formed in the gas flame.

DESCRIPTION OF THE PREFERRED EMBODIMENTS

The present invention will hereinbelow be described in further detail with reference to the accompanying drawings.

Figure 1A:
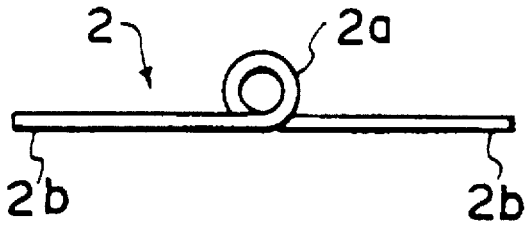
FIGS. 1A, 1B, and 1C are front views showing steps for producing an embodiment of the flame reaction member for gas combustion appliances in accordance with the present invention.
Figure 1B:
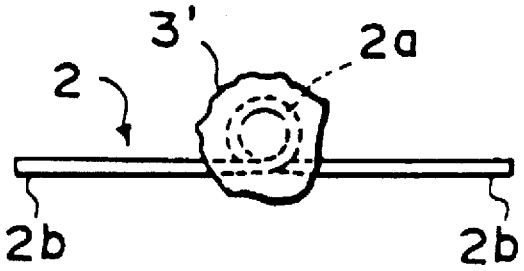
Figure 1C:
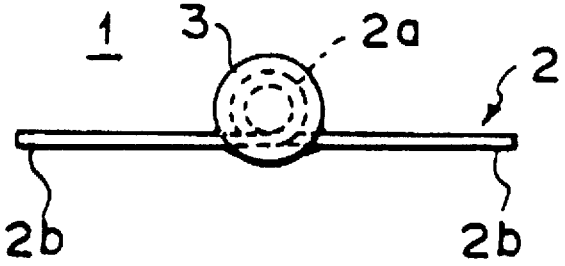
Figure 2:
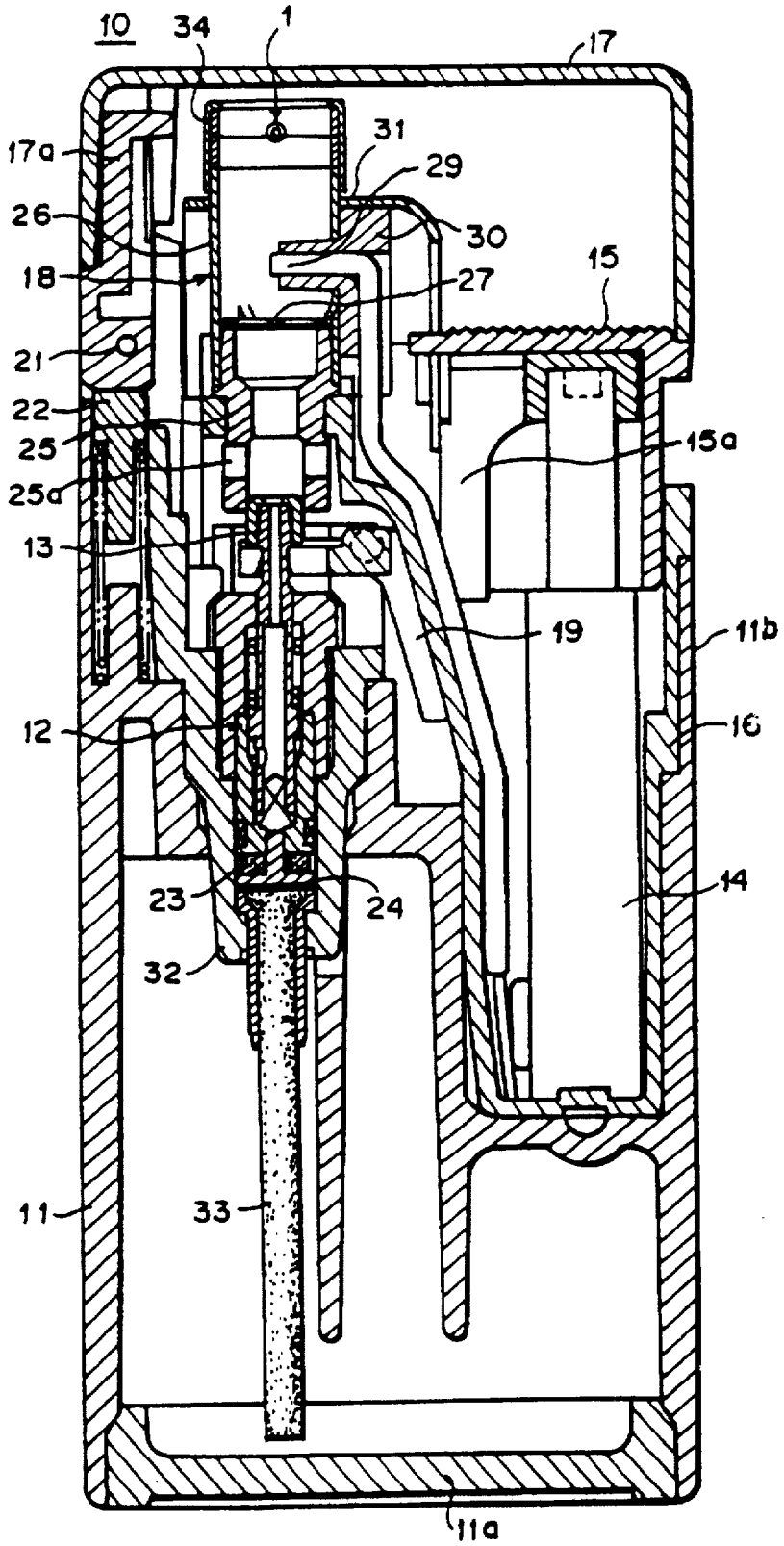
FIG. 2 is a vertical sectional view showing a gas lighter serving as a gas combustion appliance, which is provided with the embodiment of the flame reaction member in accordance with the present invention.
Figure 3:
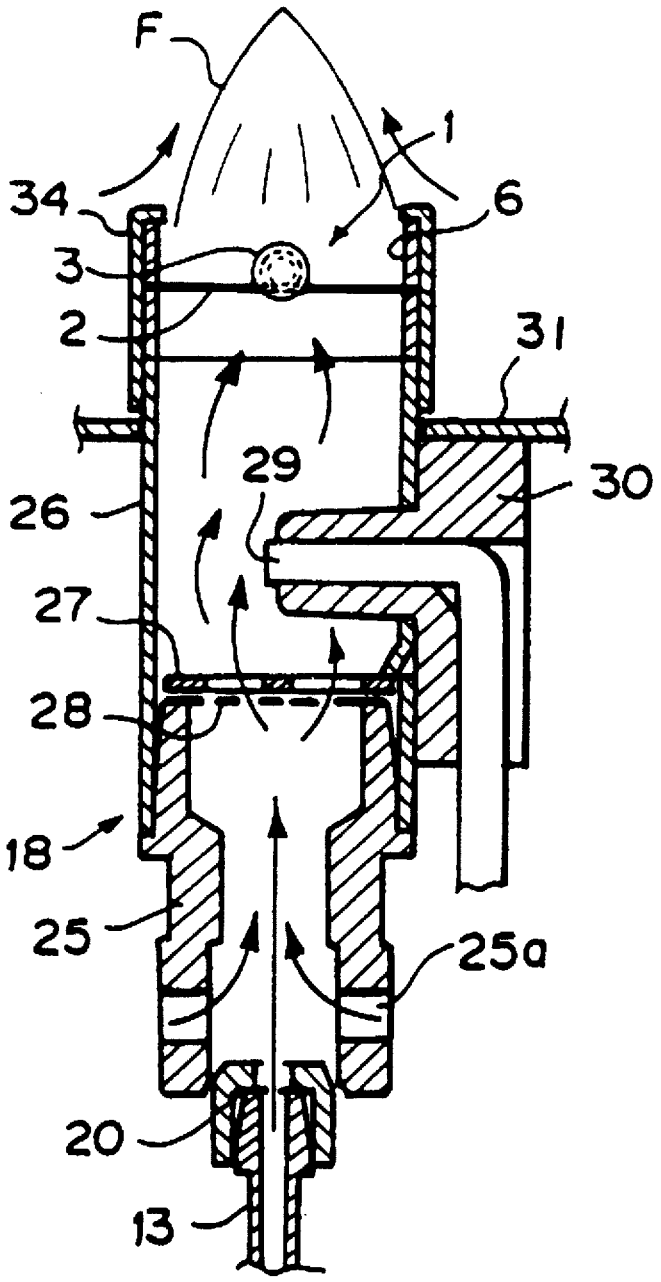
FIG. 3 is an enlarged sectional view showing a major part of the gas lighter shown in FIG. 2.

In the embodiments described below, flame reaction members are applied to a gas lighter serving as gas combustion appliances. FIGS. 1A, 1B, and 1C are front views showing steps for producing an embodiment of the flame reaction member for gas combustion appliances in accordance with the present invention. FIG. 2 is a vertical sectional view showing a gas lighter provided with the embodiment of the flame reaction member in accordance with the present invention. FIG. 3 is an enlarged sectional view showing a major part of the gas lighter shown in FIG. 2.

As illustrated in FIG. 1C, a flame reaction member 1 comprises a substrate 2, which is constituted of a heat-resistant material, such as a nickel-chrome alloy wire (hereinafter referred to as the nichrome wire), and a glass sphere-shaped flame reaction material 3, which is constituted of a glass compound having been fusion bonded to the substrate 2.

As illustrated in FIG. 1A, the substrate 2 has a coiled portion 2*a*, which is formed by coiling the middle portion of the nichrome wire two turns, and linear fitting portions 2*b*, 2*b*, which extend from the opposite ends of the coiled portion 2*a*. By way of example, the diameter of the nichrome wire is 0.15 mm, and the coil diameter (the coil outer diameter) of the coiled portion 2*a* is approximately 1.0 mm.

The flame reaction member 3 is fusion bonded to the coiled portion 2*a* of the substrate 2. Specifically, a flame reaction agent, which is constituted of an oxide or a salt of a metal capable of undergoing a flame reaction, and a fused material, which is capable of being mixed and fused together with the flame reaction agent and vitrified, are mixed with each other. The resulting mixture is then processed in order to obtain a viscous liquid-like mixed material 3'. As illustrated in FIG. 1B, the viscous liquid-like mixed material 3' is applied onto the coiled portion 2*a* of the substrate 2 and heated to a temperature not lower than the melting point of the mixed material 3'. In this manner, as illustrated in FIG. 1C, the flame reaction material 3, which comprises the resulting molten glass compound and takes on the form of a sphere due to its surface tension, is fusion bonded to the substrate 2.

As the metal elements of the flame reaction agent, which are capable of undergoing flame reactions, the elements listed below are known, which provide the flame colors listed below.

Carmine . . . Li Deep red . . . Rb, Crimson . . . Sr, Orange-red . . . Ca, Yellow . . . Na, Yellow-green. . . Tl, Green-yellow . . . Ba, Mo, Blue-green . . . Cu, Blue . . . Ga, Light blue . . . As, Sb, Sn, Pb, $PO_4$, Indigo . . . In, Blue-violet . . . Cs, Violet . . . K Oxides or salts of the above-enumerated metal elements are employed as the flame reaction agents.

The fused material is constituted of a mixture of an oxide or a salt, which is other than the flame reaction agent, and a low-fused glass material. Alternatively, the fused material may be constituted of only the oxide or the salt without the low-fused glass material being mixed. As another alternative, the fused material may be constituted of only the low-fused glass material. As the oxide or the salt other than the flame reaction agent, a substance is selected which has the properties for enhancing the color forming characteristics of the flame reaction agent, the properties for improving the heat-resistance strength, and the like. By way of example, at least one of $B_2O_3$, $Al_2O_3$, $SiO_2$, and $ZrO_2$ is employed as the oxide or the salt other than the flame reaction agent. Blending examples of the fused materials will be described later in Examples 1, 2, 3, and 4.

The low-fused glass material described above is selected from powder-like glass frits for adhesion, which do not adversely affect the flame reaction and which have low melting points. Examples of the compositions of the glass frits are listed in Table 1 below.

TABLE 1

| Glass frit | Melting point | Composition | | | | | |
|---|---|---|---|---|---|---|---|
| | | $SiO_2$ | $Al_2O_3$ | $B_2O_3$ | PbO | | |
| NO. 1 | 625° C. | 15.0% | 5.0% | 20.0% | 60.0% | | |
| | | $SiO_2$ | ZnO | $B_2O_3$ | | | |
| NO. 2 | 750° C. | 10.0% | 65.0% | 25.0% | | | |
| | | $SiO_2$ | $Al_2O_3$ | $B_2O_3$ | $Na_2O$ | $K_2O$ | $Fe_2O_3$ |
| NO. 3 | 1240° C. | 80.9% | 2.3% | 12.7% | 4.0% | 0.04% | 0.03% |

The low-fused glass materials (hereinafter referred to as the glass frits) listed in Table 1 above by themselves undergo slight flame reactions. The No. 1 glass frit forms a pale violet flame color, the No. 2 glass frit forms a pale orange flame color, and the No. 3 glass frit forms an orange flame color. In cases where the flame color formed by the glass frit does not obstruct the desired flame color formed by the flame reaction agent, the glass frit is mixed with the flame reaction material 3 in order to enhance the strength of the flame reaction material 3 and to improve the practical performance of the flame reaction member 1. In cases where the flame color formed by the glass frit obstructs the desired flame color formed by the flame reaction agent, an appropriate glass frit having a different composition is selected. In cases where such an appropriate composition of a glass frit cannot be set, no glass frit is mixed with the flame reaction material 3, and the flame reaction material 3 is constituted only of the aforesaid flame reaction agent and the aforesaid oxide or the salt other than the flame reaction agent.

A glass frit having a comparatively high melting point, such as the No. 3 glass frit, has the characteristics such that it can firmly fusion bond the flame reaction material 3 to the substrate 2.

In a process for producing the flame reaction member 1, powder of the flame reaction agent and powder of the fused material are mixed with each other, and a binder is added to the mixed powder in order to obtain a viscous mixed material 3'. A predetermined amount of the viscous mixed material 3' is applied to the coiled portion **2*a* of the substrate 2, dried at normal temperatures, and thereafter heated and kept at, for example, 300° C. for 15 minutes. By the heating step, the binder is burned off. Further, the mixed material 3' is heated and baked at a temperature not lower than its melting point, for example, at 800° C., for 30 minutes. In the baking step, the mixed material 3' having been applied to the coiled portion 2*a* is molten and vitrified and takes on the form of a sphere covering the coiled portion 2*a* and the area inward from the coiled portion 2*a* due to the surface tension. The mixed material 3' having thus been baked is cooled and solidified. In this manner, the glass sphere-like flame reaction material 3 is fusion bonded to the substrate 2**.

The structure of the gas lighter, in which the flame reaction member 1 is employed, will be described hereinbelow with reference to FIGS. 2 and 3.

A gas lighter 10 is provided with a tank body 11, which stores a fuel gas and is located at the lower part of the gas lighter 10. The tank body 11 is made by molding a synthetic resin. A bottom cover **11*a* is fitted to the bottom portion of the tank body 11, and a high-pressure fuel gas, such as butane gas, is stored in the tank body 11. A side wall 11*b* is integrally molded at the upper peripheral surface of the tank body 11. A valve mechanism 12, which is provided with a nozzle 13 for jetting the fuel gas, is accommodated in a valve housing 32. The valve housing 32, in which the valve mechanism 12 is accommodated, is fitted into an upper end of the tank body 11. A combustion cylinder 18, in which the fuel gas having been jetted from the nozzle 13 is burned, is located above the nozzle 13. The combustion cylinder 18** is of the internal combustion type, in which primary air is mixed into the fuel gas such that the fuel gas may burn perfectly at high temperatures. As a result, a colorless (or pale blue) combustion flame is produced, and good effects of the flame reaction can be obtained.

A piezo-electric unit 14 is located along a side of the valve mechanism 12. An operation member 15 is located at an upper end of the piezo-electric unit 14. The operation member 15 operates the valve mechanism 12 in order to jet the fuel gas from the nozzle 13 and operates the piezo-electric unit 14 in order to light the fuel gas having been jetted from the nozzle 13. The piezo-electric unit 14, the operation member 15, and the combustion cylinder 18 are supported by an inner housing 16 and coupled with the tank body 11.

A rising-falling type of cover 17 opens and closes the upper part of the combustion cylinder 18 and the area above the operation member 15. A fulcrum member **17*a* is secured to the cover 17 and pivotably supported on the tank body 11 by a pin 21. A push-up member 22 is urged upwardly such that it may come into contact with either one of two surfaces of the fulcrum member 17*a* in order to hold the cover 17** at the open position or the closed position.

In the valve mechanism 12, a fuel gas flow path is opened by an upward movement of the nozzle 13, and the fuel gas is jetted from a top end of the nozzle 13. An L-shaped actuating lever 19 is located such that its one end may be engaged with the nozzle 13. The actuating lever 19 is pivotably supported by a fulcrum located at an intermediate portion of the actuating lever 19. An operating portion at the other end of the actuating lever 19 comes into contact with a lever push piece 15*a* of the operation member 15 and is thereby rotated. In this manner, the actuating lever 19 actuates and ceases the jetting of the fuel gas from the nozzle 13. A nozzle plate 20, which is shown in FIG. 3 and has a hole having a predetermined diameter (for example, 50 μm), is located at the top end of the nozzle 13. The nozzle plate 20 is fitted into the bottom of the combustion cylinder 18, and the fuel gas is quickly jetted into the combustion cylinder 18.

Also, the valve mechanism 12 is provided with a gas flow rate adjusting filter 23, which adjusts such that the amount of the fuel gas jetted may be kept approximately at a predetermined value even if the temperature changes. The gas flow rate adjusting filter 23 is located in a compressed state at the bottom of the valve mechanism 12 by a nail-like stator 24. The liquefied fuel gas moves through a porous core 33 from the tank. The liquefied fuel gas, which has moved through the porous core 33, flows radially from the outer periphery of the gas flow rate adjusting filter 23 towards the center of the gas flow rate adjusting filter 23 and is thus vaporized. The gas flow rate adjusting filter 23 is constituted of a micro-cell polymer foam comprising open cells, which communicate with one another through micro-pores at points of contact and thus constitute a gas flow path, and closed cells, which expand or contract with a change in temperature and thereby compress or enlarge the gas flow path. The gas flow rate adjusting filter 23 has the effects of automatically adjusting the gas flow rate with respect to a change in temperature.

As illustrated also in FIG. 3, the combustion cylinder 18 comprises a base member 25, which is located at the base portion of the combustion cylinder 18, and a combustion pipe 26, which is secured to the base member 25 and extends upwardly. The base member 25 has a gas flow path, which extends through the center portion of the base member 25. The bottom end of the base member 25 is fitted onto the top end of the nozzle 13. A radially-extending primary air hole 25*a* opens on opposite sides of the base member 25 and at a position above the bottom end of the base member 25.

An eddy flow plate 27 and a metal mesh member 28 are placed on the top end of the base member 25. The eddy flow plate 27 is constituted of a metal disk having apertures. The eddy flow plate 27 produces a turbulent flow in of the fuel gas flow and thereby enhances the mixing of the fuel gas and the primary air. The metal mesh member 28 is constituted of circular wire gauze and prevents a back flow of the flame.

The operation member 15 is supported by being associated with the piezo-electric unit 14 such that the operation member 15 can slide downwardly. An electrical discharge electrode 29, which is connected to the piezo-electric unit 14, is located along a side of the operation member 15. The electrical discharge electrode 29 is held by an electrode holder 30, which extends through the side wall of the combustion pipe 26, such that an end of the electrical discharge electrode 29 may stand facing the area inside of the combustion pipe 26.

An outer peripheral portion of the base member 25 of the combustion cylinder 18, which portion is located above the primary air hole 25*a*, is engaged with and supported by the inner housing 16. The base member 25 is thus supported together with the combustion pipe 26. The combustion cylinder 18 is associated with the electrical discharge electrode 29 and the electrode holder 30, and a cover 31 is located on the outward side of the electrode holder 30. The combustion cylinder 18 is secured in this manner. These members are assembled together with the piezo-electric unit 14 and the operation member 15 by the inner housing 16. The assembly is assembled to the tank body 11. Therefore, the assembling work can be kept simple.

The flame reaction member 1 is located in the vicinity of the top end of the combustion pipe 26 of the combustion cylinder 18. The fitting portions 2*b*, 2*b* extending from the opposite ends of the coiled portion 2*a* of the flame reaction member 1 are secured to an annular member 6, which has the same shape as the shape of the combustion pipe 26, and the catalyst member 1 is located radially in the annular member 6. The annular member 6 is located at the top end of the combustion pipe 26, and a cap 34 is fitted onto the outer periphery of the annular member 6 and the outer periphery of the combustion pipe 26. In this manner, the flame reaction member 1 is located at the opening of the fire outlet at the top end of the combustion pipe 26.

In the gas lighter 10 constructed in the manner described above, when the cover 17 is opened and the operation member 15 is pushed down, the lever push piece 15*a* of the operation member 15 causes the actuating lever 19 to rotate. The nozzle 13 is thus moved up by the actuating lever 19. As a result, the fuel gas is jetted from the nozzle 13. The primary air is introduced from the primary air hole 25*a*, which opens through the side wall of the base member 25 of the combustion cylinder 18, by the effects of a negative pressure, which is produced by the flow velocity and the flow rate of the fuel gas being jetted from the nozzle 13. The primary air having been introduced from the primary air hole 5 is mixed with the jetted fuel gas. The primary air and the fuel gas pass through the metal mesh member 28 for preventing a back flow of the flame and thereafter stirred and mixed together by the eddy flow plate 27. The resulting mixed gas flows upwardly in the combustion pipe 26.

When the operation member 15 is pushed down even further, the piezo-electric unit 14 is actuated by the operation member 15. In this manner, a high voltage for electrical discharge is applied to the electrical discharge electrode 29, discharge is caused to occur, and the mixed gas is lighted. As a result, the air-mixed gas burns, moves upwardly, passes through the flame reaction member 1, and goes from the combustion cylinder 18 to the exterior. The mixed gas moving upwardly from the combustion cylinder 18 is mixed with secondary air at the top end of the combustion cylinder and undergoes perfect combustion.

At this time, due to the relationship between the rate of combustion of the mixed gas and the upward flow rate of the mixed gas, the combustion of the mixed gas occurs such that, though the mixed gas is burned in the region inward from the top end of the combustion cylinder 18, the mixed gas is present together with an unburned gas flow in this region. Also, though the temperature of the region in the vicinity of the flame reaction member 1 rises due to the heat of combustion, this region becomes an imperfect combustion region, which has a reducing atmosphere. When the mixed gas arrives at the top end of the combustion cylinder 18, the combustion gas flow is diffused to the external air and, at the same time, the secondary air is mixed into the mixed gas. Therefore, at this instant, the mixed gas is burned perfectly, the temperature rises sharply from the temperature of the region inward from the top end of the combustion cylinder 18, and the combustion is continued.

The flame reaction material 3 of the flame reaction member 1 comprises the glass compound, which contains the material having a low melting point falling within the range of approximately 600° C. to approximately 1,200° C. Therefore, when the gas is lighted in the gas lighter 10, the flame reaction material 3 becomes molten as the temperature rises. As described above, the flame reaction material 3 contains the oxide or the salt of the metal, which serves as the flame reaction agent, and the oxide or the salt, which forms the glass compound. The action of the molecules becomes active as the temperature rises, the flame reaction agent is reduced by the reducing atmosphere of the gas flame, and the metal atoms are thus dissociated and scattered. The scattered metal atoms are moved upwardly together with the gas flow, carried into the perfect combustion flame, and heated to a high temperature in the perfect combustion flame. As a result, the metal atoms are excited to produce the line spectrum having a wavelength inherent to the metal and thereby forms a color. In this manner, the gas flame is colored.

From the viewpoint of prevention of breakage, or the like, the flame reaction member 1 should preferably be located at a position more inward from the top end of the combustion cylinder 18. However, the flame reaction member 1 should be located at a position in the region, which becomes the reducing atmosphere and in which the temperature rise is quick, in accordance with the temperature distribution of the gas flame.

The present invention will further be illustrated by the following nonlimitative examples.

EXAMPLE 1

The flame reaction member 1 employed in this example was constituted to form a blue-green color. The metal element in the flame reaction material 3 of the flame reaction member 1, which metal element was capable of undergoing a flame reaction, was Cu, and copper oxide CuO was employed as the flame reaction agent. As a portion of the fused material for forming a stable glass compound containing the flame reaction agent (i.e., the metal oxide), boron oxide $B_2O_3$ and aluminum oxide $Al_2O_3$, which did not obstruct the flame color formed by Cu, were selected. These constituents were mixed together in proportions falling within a predetermined range (which will be described later), and a $CuO—B_2O_3—Al_2O_3$ ternary material was thereby obtained.

Also, as a portion of the fused material for obtaining the glass compound, a low-fused glass material was added. As the low-fused glass material, the No. 2 glass frit listed in Table 1 above, which had the composition of $SiO_2—ZnO—B_2O_3$ and a melting point of 750° C., was selected. The glass frit was added in a proportion of 30% by weight with respect to the ternary material. A 5% aqueous solution of a polyvinyl alcohol serving as a binder was added to the resulting mixed powder. The mixture thus obtained was kneaded, and a viscous liquid-like mixed material was thereby prepared. A predetermined amount of the viscous liquid-like mixed material was then applied to the coiled portion 2*a* of the substrate 2.

The mixed material, which had been applied to the coiled portion 2*a* of the substrate 2, was dried at normal temperatures, put into a heating furnace, and kept at a temperature of 300° C. for 15 minutes. In this manner, the binder was thermally decomposed and removed. Thereafter, the temperature was raised even further, and the mixed material was heated and baked at 800° C. for 30 minutes. The melting point of the mixed material was approximately 750° C., and therefore the mixed material was fused when being heated to the temperature above its melting point. The mixed material having thus been fused took on the form of a sphere due to its surface tension. After being cooled, the mixed material formed a glass compound, and the flame reaction material 3 was thereby fusion bonded to the substrate 2.

Specifically, as the flame reaction member 1 to be incorporated into the actual gas lighter 10, 0.3 g of CuO, 0.28 g of $B_2O_3$, and 0.12 g of $Al_2O_3$ were mixed together, and 0.4 g of the $SiO_2—ZnO—B_2O_3$ glass frit described above was mixed with the resulting mixture. Thereafter, 1.5 g of the 5% aqueous solution of the polyvinyl alcohol was added to the mixed powder having thus been obtained, and the resulting mixture was stirred to form the viscous liquid-like mixed material. The viscous liquid-like mixed material was applied to the coiled portion 2*a* of the substrate 2 shown in FIG. 1A. The viscous liquid-like mixed material having been applied to the coiled portion 2*a* was dried at normal temperatures, and then the polyvinyl alcohol was burned off and removed by heating the mixed material at 300° C. for 15 minutes. The mixed material was then baked at 800° C. for 30 minutes and was thereby fusion bonded to the substrate 2.

The blending proportions described above were typical examples of appropriate conditions. In various experiments carried out, the blending proportions in the $CuO—B_2O_3—Al_2O_3$ ternary material were changed variously, and various samples of the flame reaction member 1 were thereby obtained. Each of the samples of the flame reaction member 1 was incorporated in the gas lighter 10 shown in FIG. 2, and characteristics of the flame reaction member 1 were determined. The results described below were obtained. From the results thus obtained, an appropriate range of the blending proportions was found. The characteristics required for the flame reaction member 1 to be loaded in the gas lighter 10 included the characteristics such that the color formation of the gas flame should occur quickly after the lighting of the gas, and such that the flame reaction member 1 should have a strength and durability capable of enduring thermal changes during repeated lighting operations. The tests described below were carried out in order to determine such characteristics.

1. Vitrification test

The vitrification test was carried out in order to investigate whether the flame reaction material 3 could or could not easily vitrify at low temperatures. Specifically, the blending proportions in the ternary material described above were changed variously, and 30% of the aforesaid No. 2 glass frit was mixed with each of the ternary materials. The binder was then added, and viscous liquid-like mixed materials were thereby obtained. Each of the viscous liquid-like mixed materials was then applied to the substrate 2, dried at normal temperature, and heat treated at 300° C. for 15 minutes in a heating furnace. Thereafter, the mixed material was baked at 800° C. for 30 minutes, and the flame reaction material 3 was thereby fusion bonded to the substrate 2. In this manner, various samples of the flame reaction member 1 were obtained. At this time, the state of fusion bonding of the flame reaction material 3 to the substrate 2 was judged visually. The results shown in FIG. 4 were obtained. In cases where the flame reaction material 3 was fusion bonded in a spherical shape to the substrate 2, it was judged that the flame reaction material 3 was vitrified perfectly. In cases where the flame reaction material 3 was in a solid state, it was judged that the flame reaction material 3 was vitrified approximately.

Figure 4:
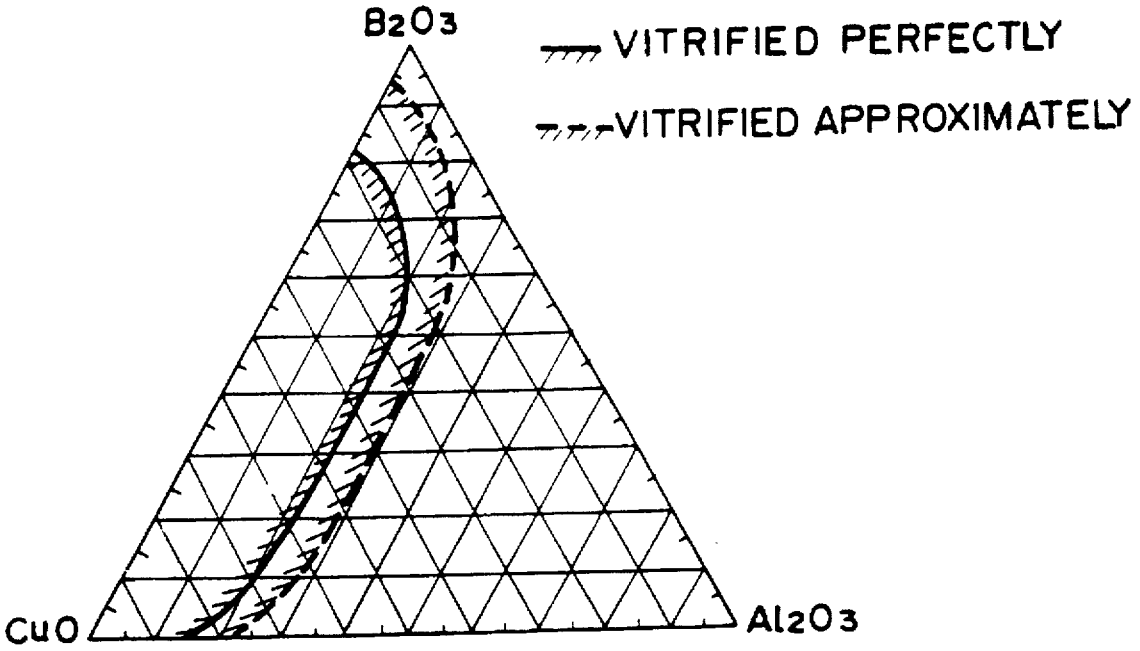
FIG. 4 is a diagram showing the relationship between blending proportions in a ternary material employed in Example 1 and a vitrification range of the ternary material.

In FIG. 4 and those that follow, which show the blending proportions, the blending proportions of the substance indicated at the vertex are plotted such that the opposite side represents 0%, and the vertex represents 100%. The lines parallel to the opposite side represents the graduations at intervals of 10%.

2. Compression strength test

Figure 5:
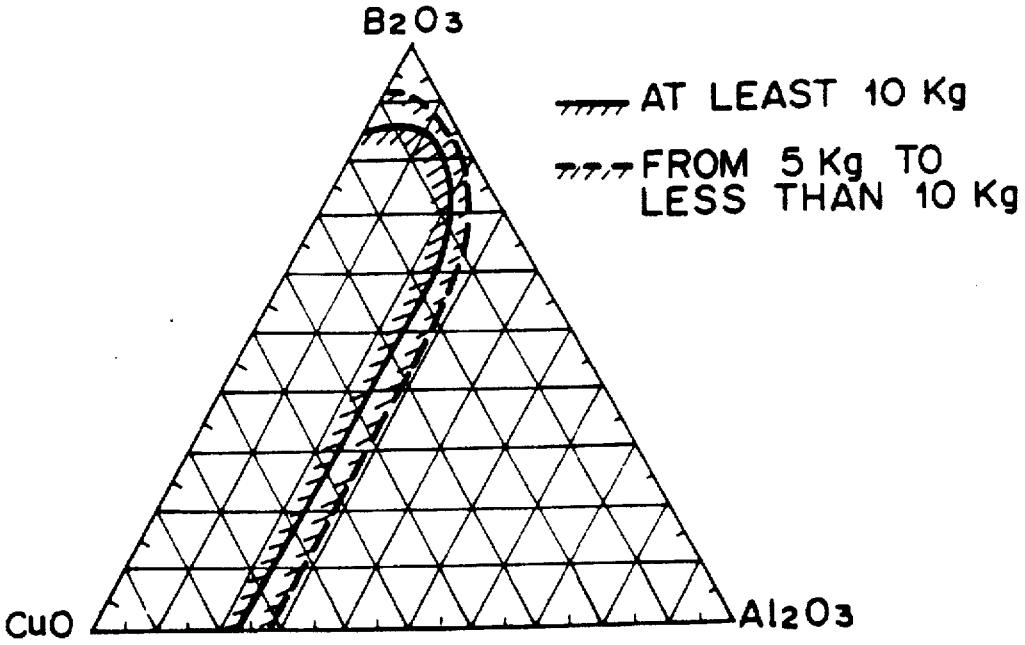
FIG. 5 is a diagram showing the relationship between the blending proportions in the ternary material employed in Example 1 and a compression strength of the ternary material.

The compression strength test was carried out in order to investigate whether the compression strength of the flame reaction material 3 having been fusion bonded to the substrate 2 was or was not high. Specifically, each sample of the flame reaction member 1, which had been prepared in the aforesaid vitrification test, was set in a compression tester, and a load was applied to the flame reaction material 3 of the sample in the direction of compression. The load was increased little by little, and the load value, at which the flame reaction material 3 was broken, was read out and taken as the compression strength. The results shown in FIG. 5 were obtained. In order for the flame reaction material 3 to be used satisfactorily in a gas lighter, it is sufficient that the compression strength of the flame reaction material 3 before being subjected to a durability test, which will be described later, is at least 5 kg. The compression strength of the flame reaction material 3 before being subjected to the durability test should preferably be at least 10 kg.

Examples of the measured values of the compression strengths were as shown below.

| | |
|---|---|
| CuO: 20%, $B_2O_3$: 70%, $Al_2O_3$: 10% | . . . 15.3 kg |
| CuO: 10%, $B_2O_3$: 90%, $Al_2O_3$: 0% | . . . 8.9 kg |
| CuO: 30%, $B_2O_3$: 20%, $Al_2O_3$: 50% | . . . 3.6 kg |

3. Color formation test

Figure 6:
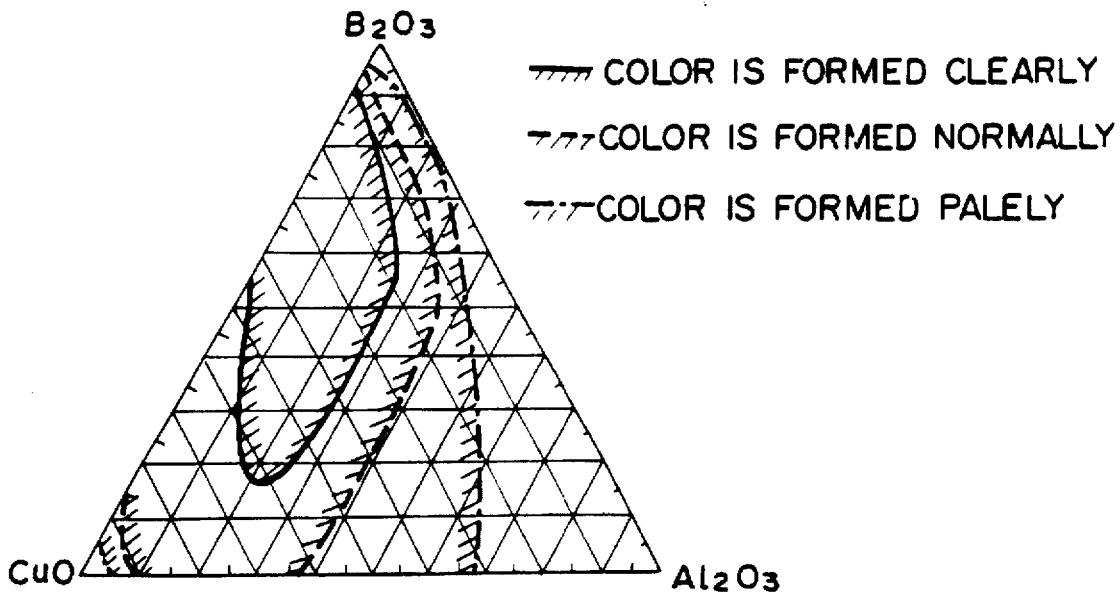
FIG. 6 is a diagram showing the relationship between the blending proportions in the ternary material employed in Example 1 and color forming characteristics of the ternary material.

The color formation test was carried out in order to investigate whether an originally desired color was or was not formed. Specifically, each sample of the flame reaction member 1, which had been prepared in the aforesaid vitrification test, was loaded into the gas lighter 10. The gas was lighted in the gas lighter 10, and the degree of color formation was judged visually. The results shown in FIG. 6 were obtained. The region, in which the color was formed deeply clearly, was the optimum region. Good results were obtained in the region, in which the color was formed normally. The region, in which the color was formed palely (or very palely), was also sufficiently applicable.

4. Durability test

Figure 7:
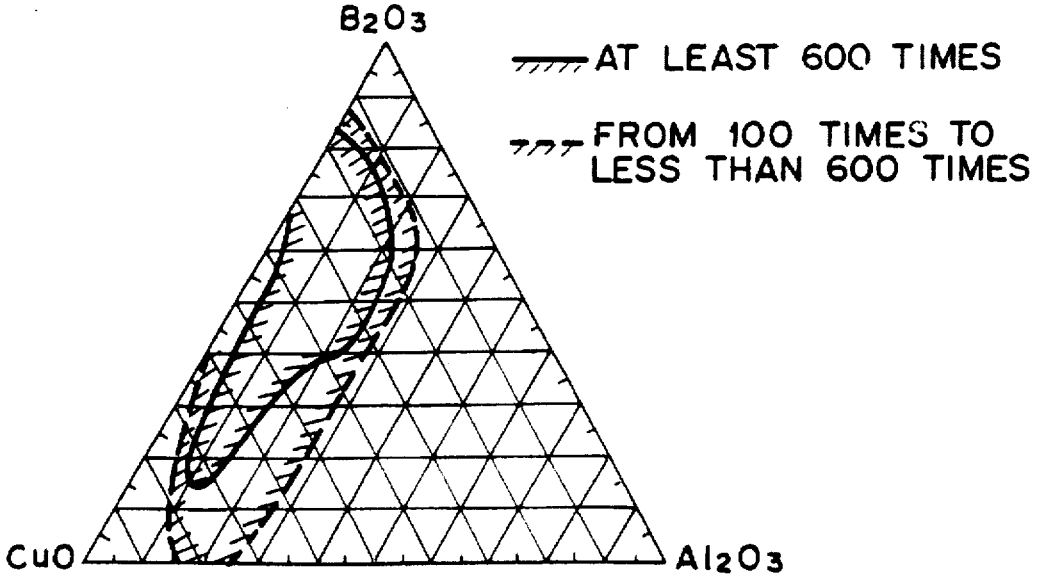
FIG. 7 is a diagram showing the relationship between the blending proportions in the ternary material employed in Example 1 and durability of the ternary material.

In the durability test, the lighting operation was repeated, and it was investigated whether the sample could or could not endure at least the number of lighting operations required for the gas lighter. Specifically, the sample was loaded into the gas lighter 10. The number of lighting operations, during which the color was formed at least normally, was counted. The results shown in FIG. 7 were obtained.

5. Continuous lighting test

Figure 8:
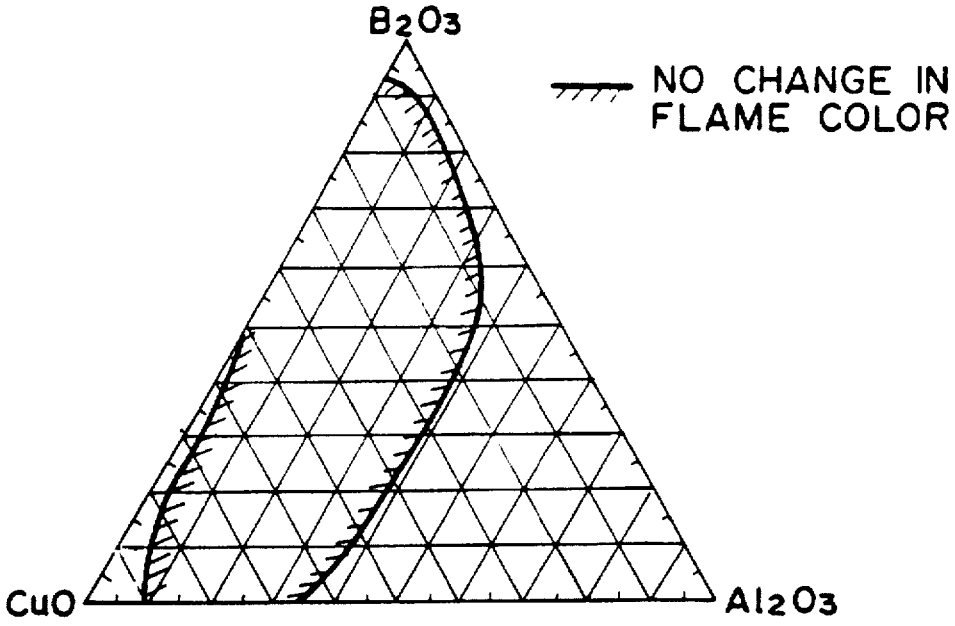
FIG. 8 is a diagram showing the relationship between the blending proportions in the ternary material employed in Example 1 and results of a continuous lighting test carried out on the ternary material.

In the continuous lighting test, the gas was burned continuously for a long time, and it was investigated whether the flame color changed or did not change. Specifically, the sample was loaded into the gas lighter 10, and the gas was burned continuously for 30 seconds. At this time, it was investigated visually whether the flame color changed or did not change. The results shown in FIG. 8 were obtained.

6. Moisture absorption test

The moisture absorption test was carried out in order to investigate whether deterioration of the sample due to moisture absorption occurred or did not occur when the sample was left to stand in the atmosphere. Specifically, the sample was left to stand for 24 hours in an atmosphere at a temperature of 50° C. and a humidity of 80%, and deterioration of the sample was investigated. As for the samples having the vitrified flame reaction material 3, no abnormality was found.

Figure 9:
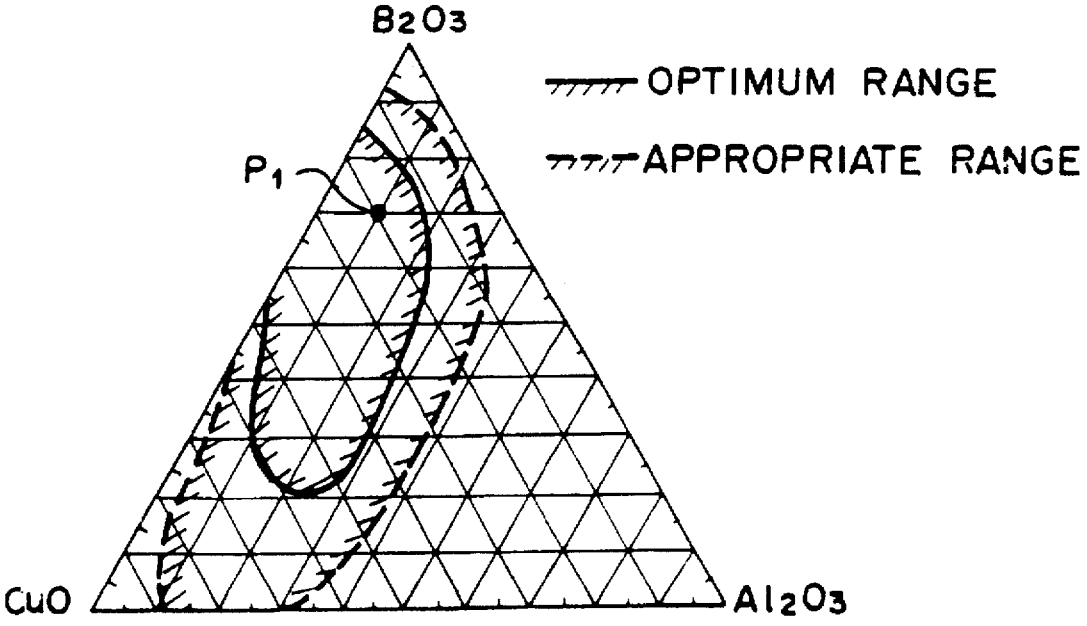
FIG. 9 is a diagram showing an appropriate blending range in the ternary material employed in Example 1.

From the results of the various tests described above, it was found that, in the vitrified region, a high compression strength can be obtained. Also, it was found that the good color formation region and the high durability region approximately coincide with the vitrified region and the high compression strength region. These regions are such that CuO is contained at least to a certain extent, the amount of $B_2O_3$ blended is high, and the amount of $Al_2O_3$ blended is comparatively small. FIG. 9 shows the composition range, which is appropriate as a whole, and the composition range, which is optimum as a whole.

Figure 10:
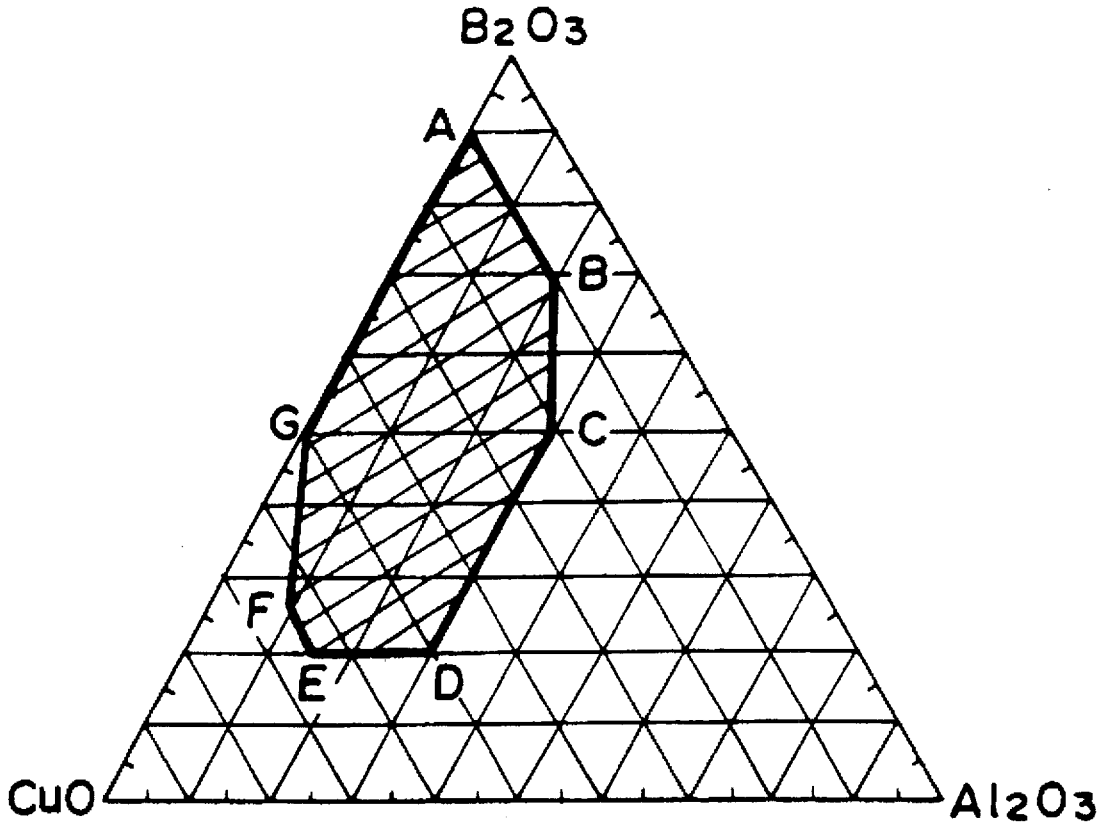
FIG. 10 is a diagram showing an optimum blending range in the ternary material employed in Example 1.

When the optimum range shown in FIG. 9 is represented approximately, the range shown in FIG. 10 is obtained, which is surrounded by a point A (CuO: 10%, $B_2O_3$: 90%, $Al_2O_3$: 0%), a point B (CuO: 10%, $B_2O_3$: 70%, $Al_2O_3$: 20%), a point C (CuO: 20%, $B_2O_3$: 50%, $Al_2O_3$: 30%), a point D (CuO: 50%, $B_2O_3$: 20%, $Al_2O_3$: 30%), a point E (CuO: 65%, $B_2O_3$: 20%, $Al_2O_3$: 15%), a point F (CuO: 65%, $B_2O_3$: 25%, $Al_2O_3$: 10%), and a point G (CuO: 50%, $B_2O_3$: 50%, $Al_2O_3$: 0%). In the aforesaid CuO—$B_2O_3$—$Al_2O_3$ ternary material, the blending proportions of CuO, $B_2O_3$, and $Al_2O_3$ should preferably fall within the range shown in FIG. 10.

Figure 11:
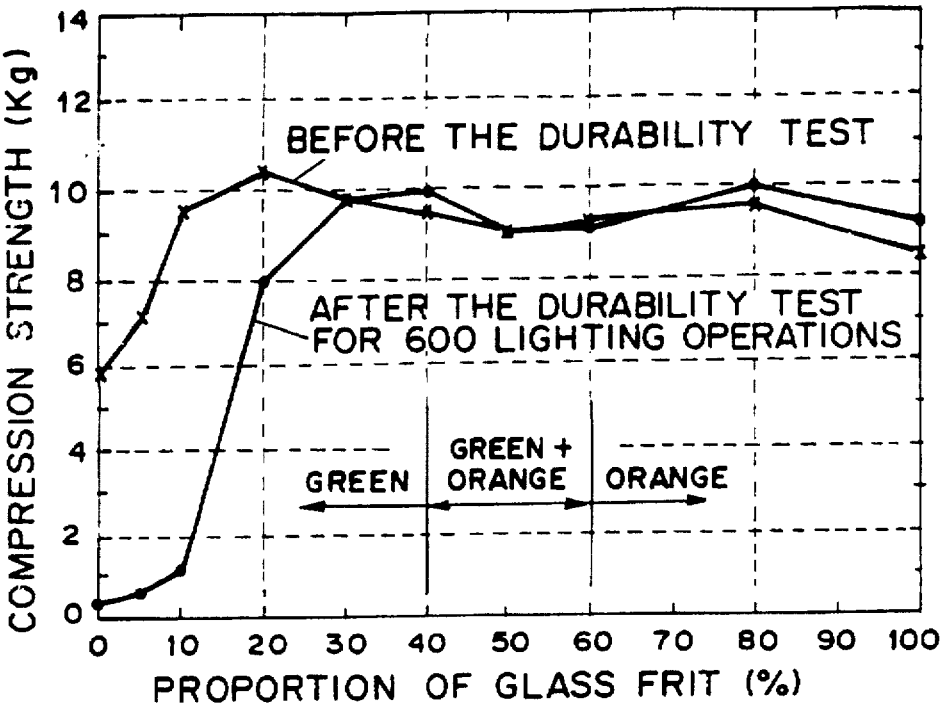
FIG. 11 is a diagram showing the relationship between a blending proportion of a glass frit with respect to the ternary material employed in Example 1 and a compression strength of the flame reaction material.

A test was further carried out in order to investigate the effects of the blending proportion of the glass frit with respect to the aforesaid ternary material. In this test, as an example of the optimum composition of the ternary material, the composition of CuO: 20%, $B_2O_3$: 70%, and $Al_2O_3$: 10% was employed. This composition coincided with a point $P_1$ shown in FIG. 9. The No. 2 low-fused glass frit listed in Table 1 above was added to the ternary material in various blending proportions of 0% to 100%. The samples of the flame reaction member 1 were prepared in the same manner as that in the aforesaid vitrification test, and the compression strength of the flame reaction material 3 of each sample was measured. The results shown in FIG. 11 were obtained. Also, each sample was loaded into the gas lighter 10, the durability test for 600 lighting operations was carried out, and then the compression strength of the flame reaction material 3 of each sample was measured. The results thus obtained were also shown in FIG. 11.

As for the blending proportion of the glass frit, in the region in which the blending proportion of the low-fused glass frit with respect to the ternary material is less than 5%, the compression strength of the flame reaction material 3 before being subjected to the durability test is low. Also, in the region in which the blending proportion of the low-fused glass frit with respect to the ternary material is less than 20%, the compression strength of the flame reaction material 3 after being subjected to the durability test decreases sharply. Further, in cases where the blending proportion of the low-fused glass frit with respect to the ternary material is higher than 40%, the formed flame color changes from a green to a green+orange color. In cases where the blending proportion of the low-fused glass frit with respect to the ternary material is higher than 60%, the formed flame color changes to an orange. Therefore, such that the blue-green color, which is the flame reaction color of Cu, may be obtained, the blending proportion of the low-fused glass frit with respect to the ternary material is restricted to at most 40%.

The flame color changing phenomenon described above occurs because the flame color formed by the No. 2 glass frit is a pale orange and, when the amount of the ternary material blended increases, the effects of the flame color formed by the glass frit become large. Also, the No. 2 glass frit contains a large amount of $B_2O_3$. The flame reaction color of $B_2O_3$ by itself is a pale green. Even if the pale green flame reaction color is mixed into the green flame color formed by Cu, no adverse effects occur on the green flame color. Also, $B_2O_3$ has the effects of color formation auxiliaries, and therefore the amount of $B_2O_3$ should preferably be as large as possible. Even if CuO serving as t he base for the green color formation is contained in a small amount, it the green flame color can be formed appropriately. Therefore, in cases where the amount of $B_2O_3$ is large, the color formation can become stable.

Figure 12:
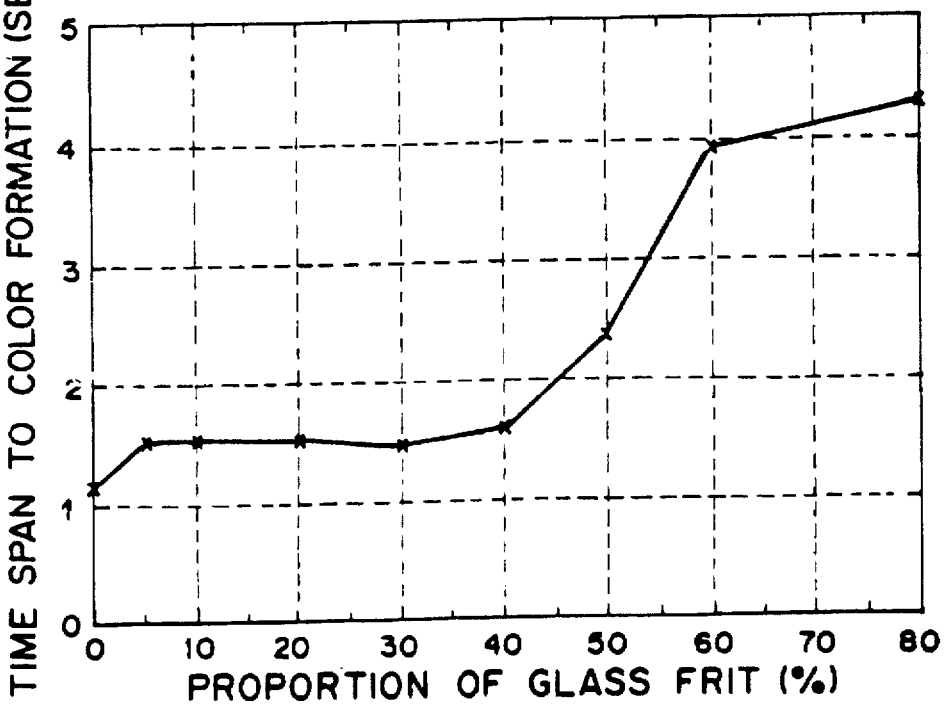
FIG. 12 is a diagram showing the relationship between the blending proportion of the glass frit with respect to the ternary material employed in Example 1 and a time span taken from lighting to color formation with the flame reaction material.

The inventors also carried out the experiments, in which the amount of the aforesaid ternary material was set to be 1.01 g, and the blending proportion of the glass frit with respect to the ternary material was changed variously. Each of the samples of the flame reaction member 1 obtained in this manner was loaded into the gas lighter 10, and the time span taken from the lighting to the color formation of the gas flame was measured. The results shown in FIG. 12 were obtained. As illustrated in FIG. 12, in cases where the blending proportion of the glass frit with respect to the ternary material is 40% or higher, the time span taken from the lighting to the color formation becomes long.

Figure 13:
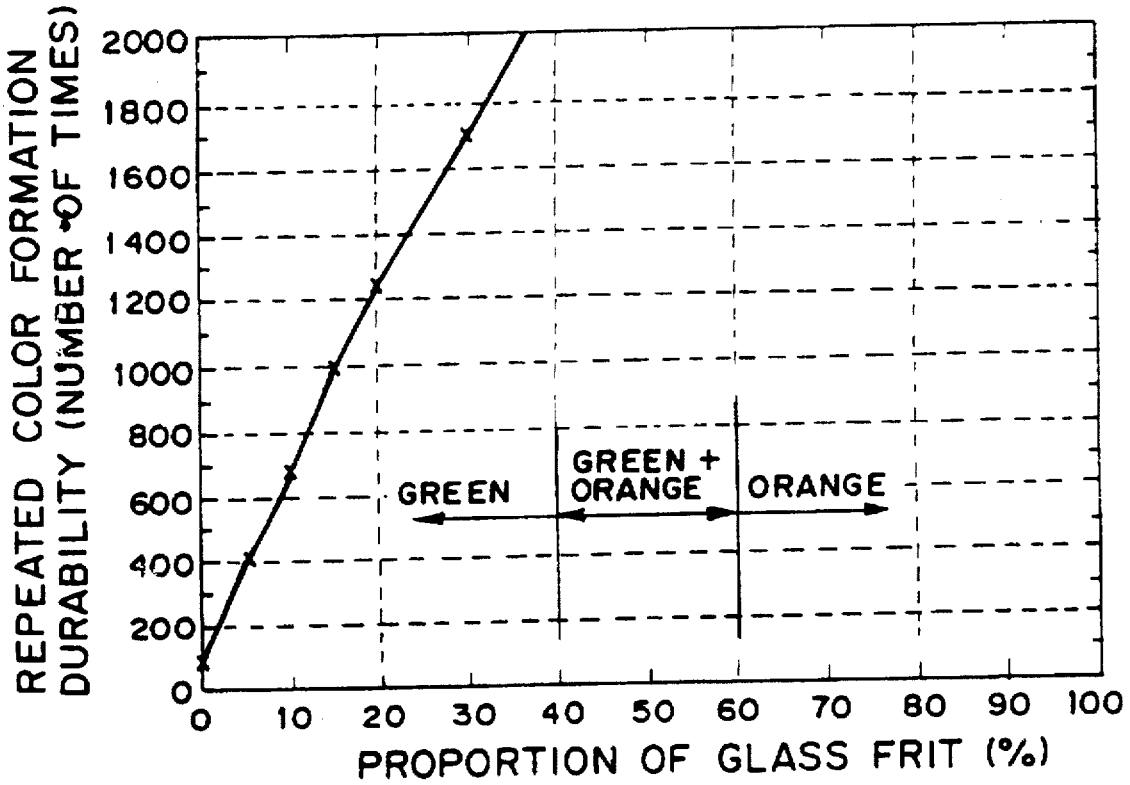
FIG. 13 is a diagram showing the relationship between the blending proportion of the glass frit with respect to the ternary material employed in Example 1 and a repeated color formation durability of the flame reaction material.

Also, in the same manner as that described above, various samples of the flame reaction member 1 were prepared by changing the blending proportion of the glass frit with respect to 0.01 g of the ternary material. Each of the samples of the flame reaction member 1 obtained in this manner was loaded into the gas lighter 10, and the repeated color formation durability, i.e. the durability life with respect to the number of times of color formations by gas lighting operations, was investigated. The results shown in FIG. 13 were obtained. As illustrated in FIG. 13, in the glass frit blending range of 0% to 40%, in which the blue-green flame color is obtained with Cu, the repeated color formation durability decreases as the blending proportion of the glass frit becomes lower.

From the results described above, the glass frit having the $SiO_2$—ZnO—$B_2O_3$ composition should preferably be blended in a proportion falling within the range of 20% to 40% by weight with respect to the CuO—$B_2O_3$—$Al_2O_3$ ternary material.

In this example, the aforesaid No. 2 glass frit was employed because it exhibited better durability with respect to the ternary material than glass frits having the other compositions did. However, it often occurs that, as for the other flame reaction agents or several other fused materials, the other glass frits are preferable.

EXAMPLE 2

The flame reaction member 1 employed in this example was constituted to form a crimson-red color. The metal element in the flame reaction material 3 of the flame reaction member 1, which metal element was capable of undergoing a flame reaction, was Li. As the flame reaction agent, lithium oxide $Li_2O$ could be used. However, $Li_2O$ powder involved a difficulty in the processing of the powder. Therefore, in this example, lithium carbonate $Li_2CO_3$ was employed as the flame reaction agent. As a portion of the fused material for forming a stable glass compound containing the flame reaction agent (i.e., the metal salt), silica $SiO_2$ and aluminum oxide $Al_2O_3$, which did not obstruct the flame color formed by Li, were selected. These constituents were mixed together in proportions falling within a predetermined range (which will be described later), and an $Li_2CO_3$—$SiO_2$—$Al_2O_3$ ternary material was thereby obtained.

Also, as a portion of the fused material for obtaining the glass compound, a low-fused glass material was added. As the low-fused glass material, the No. 2 glass frit listed in Table 1 above, which had the composition of $SiO_2$—ZnO—$B_2O_3$, was selected. The glass frit was added in a proportion of 30% by weight with respect to the ternary material. A 5% aqueous solution of a polyvinyl alcohol serving as a binder was added to the resulting mixed powder. The mixture thus obtained was kneaded, and a viscous liquid-like mixed material was thereby prepared. A predetermined amount of the viscous liquid-like mixed material was then applied to the coiled portion 2*a* of the same substrate 2 as that employed in Example 1. Thereafter, the mixed material was baked by the same heating treatment as that in Example 1, and the flame reaction material 3 was thereby fusion bonded in a spherical shape to the substrate 2.

When $Li_2CO_3$ i s heavily heated at a temperature of 1,500° C. or higher, it is thermally decomposed into $Li_2O$ and $CO_2$. However, $Li_2CO_3$ is not heated to the thermal decomposition temperature during the steps for producing the flame reaction member 1. Therefore, $Li_2CO_3$ is not decomposed, and the flame reaction material 3 can be fusion bonded as the glass compound to the substrate 2.

Specifically, as the flame reaction member 1 to be incorporated into the aforesaid gas lighter 10, 0.28 g of $Li_2CO_3$, 0.35 g of $SiO_2$, and 0.07 g of $Al_2O_3$ were mixed together, and 0.4 g of the No. 2 glass frit described above was mixed with the resulting mixture. Thereafter, 1.5 g of the 5% aqueous solution of the polyvinyl alcohol serving as the binder was added to the mixed powder having thus been obtained, and the resulting mixture was stirred to form the viscous liquid-like mixed material. The viscous liquid-like mixed material was applied to the coiled portion 2*a* of the substrate 2 shown in FIG. 1A, which was constituted of the nichrome wire. Thereafter, in the same manner as that in Example 1, the viscous liquid-like mixed material having been applied to the coiled portion 2*a* was dried at normal temperatures and then subjected to heat treatment at 300° C. for 15 minutes and heat treatment at 800° C. for 30 minutes.

Figure 14:
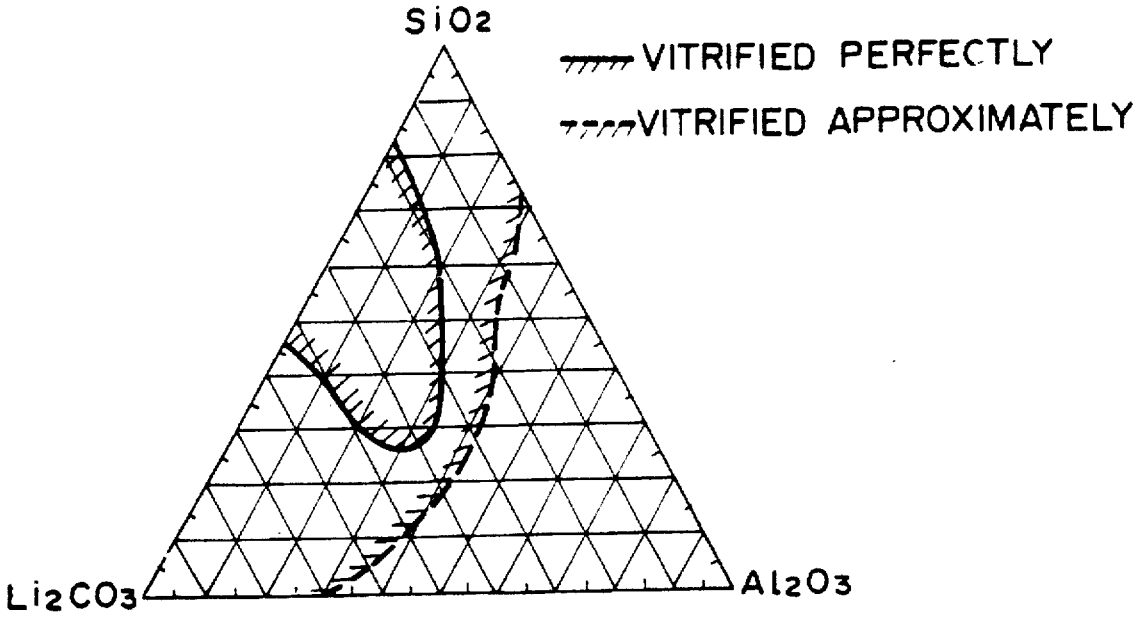
FIG. 14 is a diagram showing the relationship between blending proportions in a ternary material employed in Example 2 and a vitrification range of the ternary material.
Figure 15:
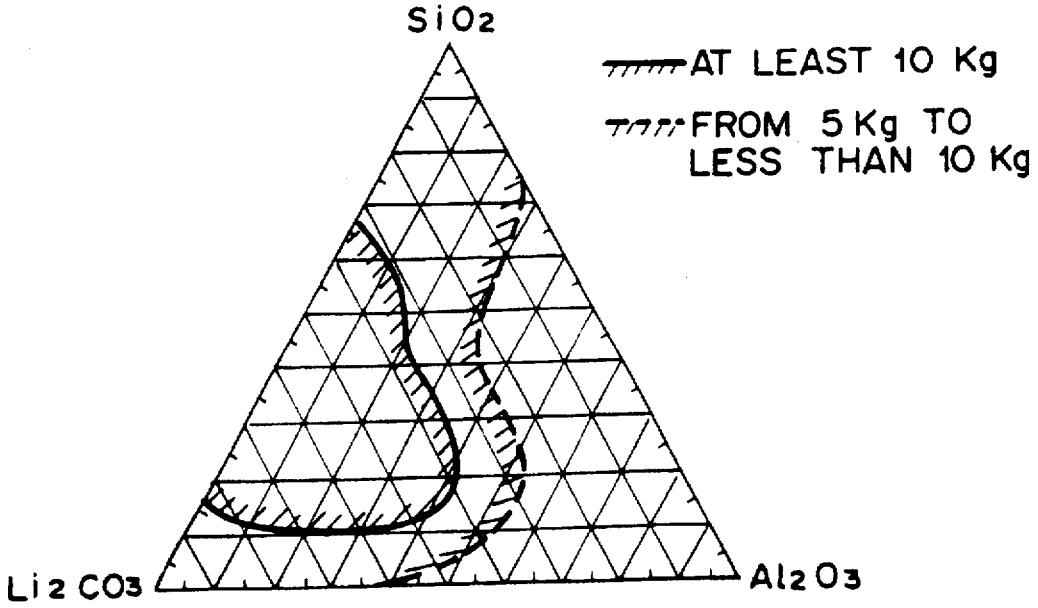
FIG. 15 is a diagram showing the relationship between the blending proportions in the ternary material employed in Example 2 and a compression strength of the ternary material.
Figure 16:
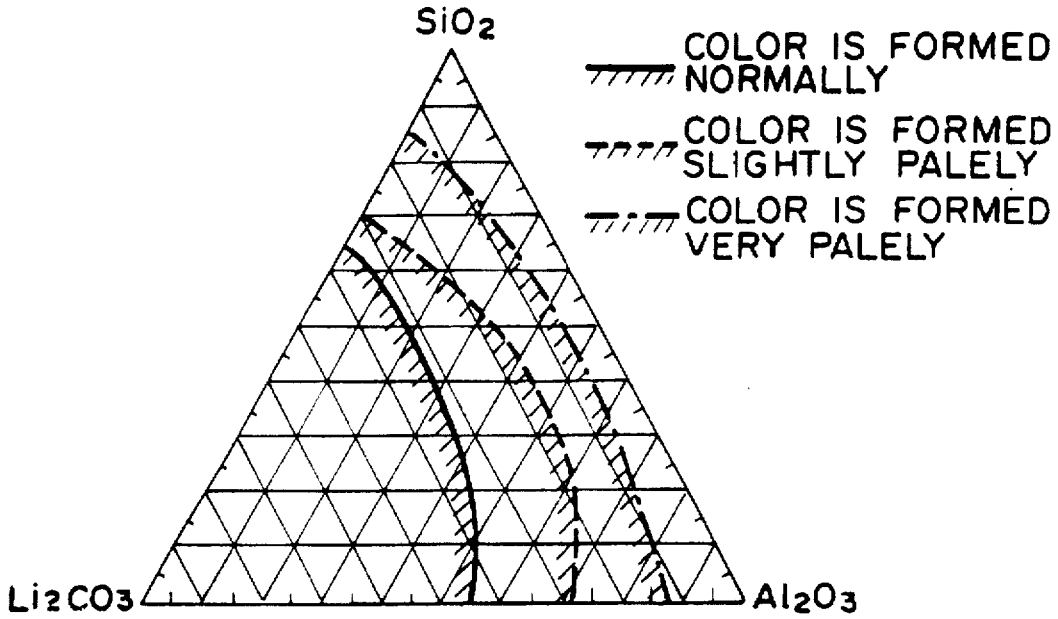
FIG. 16 is a diagram showing the relationship between the blending proportions in the ternary material employed in Example 2 and color forming characteristics of the ternary material.
Figure 17:
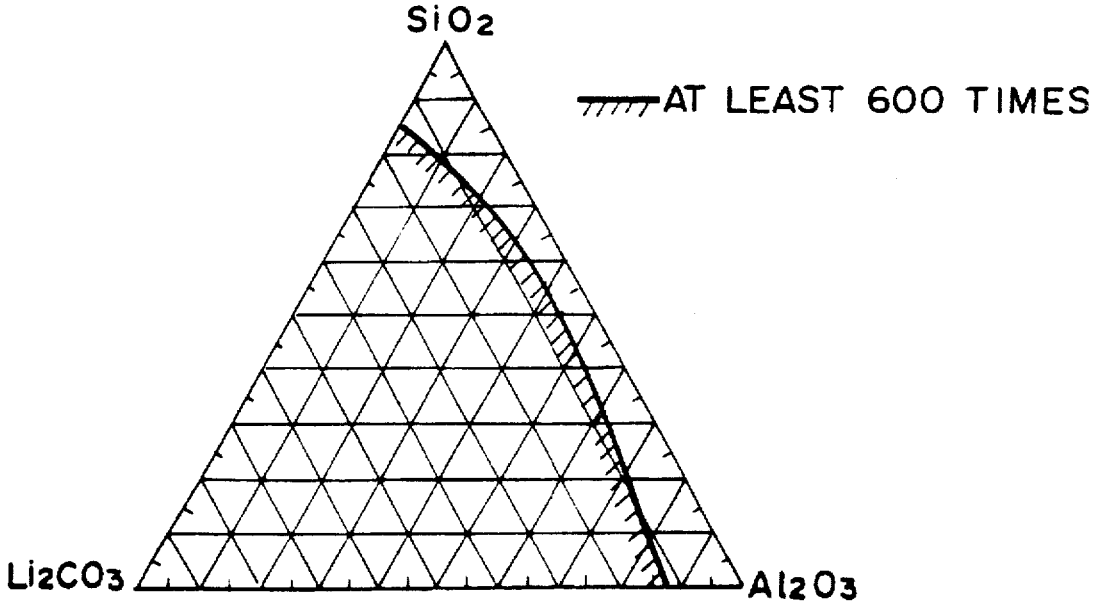
FIG. 17 is a diagram showing the relationship between the blending proportions in the ternary material employed in Example 2 and durability of the ternary material.
Figure 18:
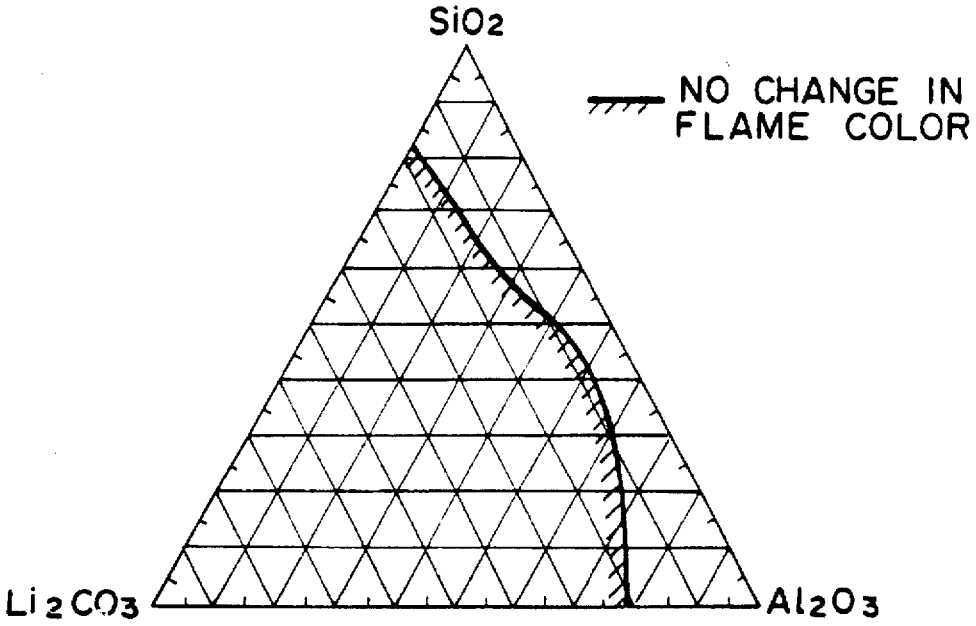
FIG. 18 is a diagram showing the relationship between the blending proportions in the ternary material employed in Example 2 and results of a continuous lighting test carried out on the ternary material.
Figure 19:
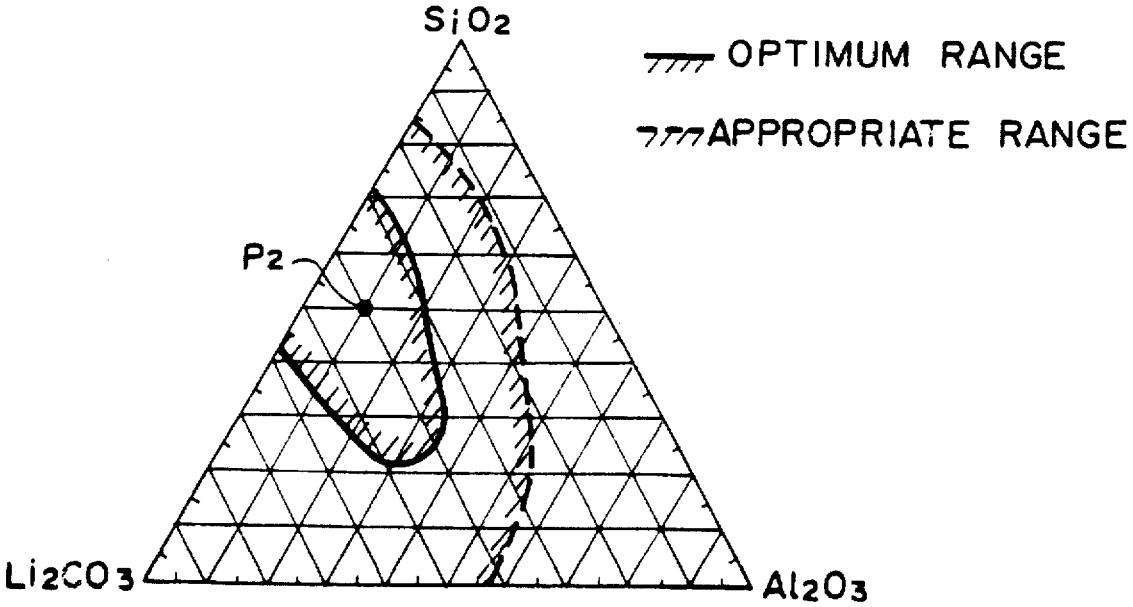
FIG. 19 is a diagram showing an appropriate blending range in the ternary material employed in Example 2.

As for the crimson-red flame reaction material 3, the tests were carried out in the same manner as that in Example 1 in order to determine an appropriate range of the blending proportions in the ternary material. As for the vitrification range, the results of the test shown in FIG. 14 were obtained. As for the compression strength, the results of the test shown in FIG. 15 were obtained. As for the color formation range, the results of the test shown in FIG. 16 were obtained. As for the durability test for 600 lighting operations, the results shown in FIG. 17 were obtained. As for the 30-second continuous lighting test, the results shown in FIG. 18 were obtained. FIG. 19 shows the composition range, which is appropriate as a whole, and the composition range, which is optimum as a whole. Also, the moisture resistance characteristics were good in the vitrified region.

From the results of the various tests described above, it was found that, in the vitrified region and the approximately vitrified region, a high compression strength can be obtained. These regions are such that $Li_2CO_3$ and $SiO_2$ are contained at least to certain extents, and the amount of $Al_2O_3$ blended is comparatively small. Also, it was found that the good color formation region approximately coincides with the high coloring durability region, and that this region is the region in which $Li_2CO_3$ is contained at least to a certain extent (approximately 10%). FIG. 19 shows the composition range, which is appropriate as a whole, and the composition range, which is optimum as a whole.

Figure 20:
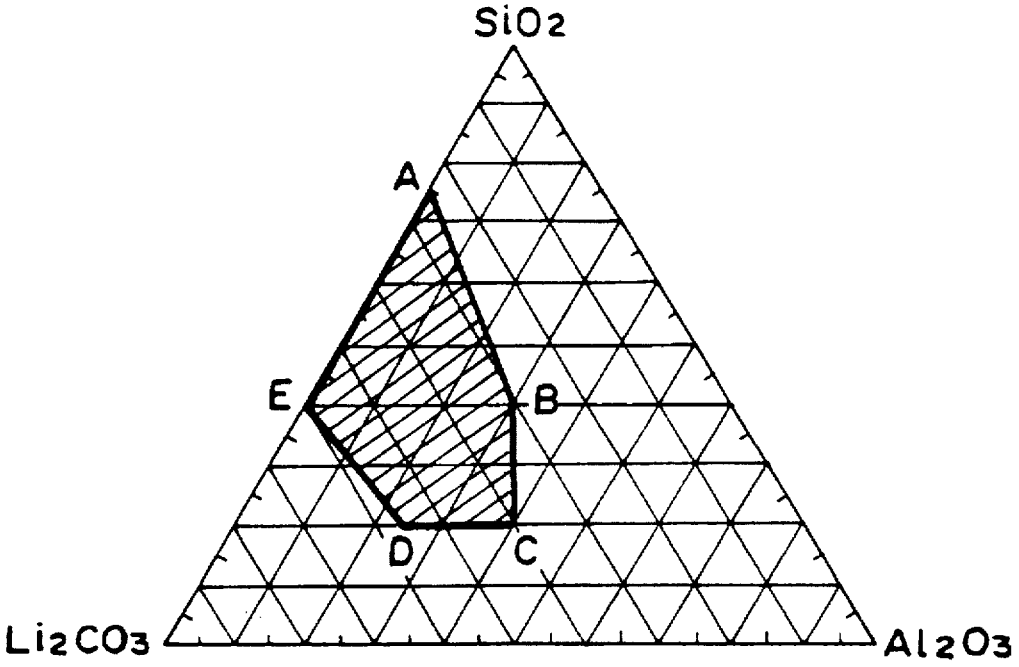
FIG. 20 is a diagram showing an optimum blending range in the ternary material employed in Example 2.

When the optimum range shown in FIG. 19 is represented approximately, the range shown in FIG. 20 is obtained, which is surrounded by a point A ($Li_2CO_3$: 25%, $SiO_2$: 75%, $Al_2O_3$: 0%), a point B ($Li_2CO_3$: 30%, $SiO_2$: 40%, $Al_2O_3$: 30%), a point C ($Li_2CO_3$: 40%, $SiO_2$: 20%, $Al_2O_3$: 40%), a point D ($Li_2CO_3$: 55%, $SiO_2$: 20%, $Al_2O_3$: 25%), and a point E ($Li_2CO_3$: 60%, $SiO_2$: 40%, $Al_2O_3$: 0%). In the aforesaid $Li_2CO_3$—$SiO_2$—$Al_2O_3$ ternary material, the blending proportions of $Li_2CO_3$, $SiO_2$, and $Al_2O_3$ should preferably fall within the range shown in FIG. 20.

A test was further carried out in order to investigate the effects of the blending proportion of the glass frit with respect to the aforesaid ternary material. In this test, as an example of the optimum composition of the ternary material, the composition of $Li_2CO_3$: 40%, $SiO_2$: 50%, and $Al_2O_3$: 10% was employed. This composition coincided with a point $P_2$ shown in FIG. 19. The No. 2 low-fused glass frit listed in Table 1 above, which had the $SiO_2$—ZnO—$B_2O_3$ composition, was added to the ternary material in various blending proportions of 0% to 100%. The samples of the flame reaction member 1 were prepared in the same manner as that in the aforesaid vitrification test, and the compression strength of the flame reaction material 3 of each sample was measured. The results shown in FIG. 21 were obtained. Also, each sample was loaded into the gas lighter 10, the durability test for 600 lighting operations was carried out, and then the compression strength of the flame reaction material 3 of each sample was measured. The results thus obtained were also shown in FIG. 21.

As for the blending proportion of the glass frit, in the region in which the blending proportion of the low-fused glass frit with respect to the ternary material is less than 5%, the compression strength of the flame reaction material 3 before being subjected to the durability test is low. Also, in the region in which the blending proportion of the low-fused glass frit with respect to the ternary material is less than 10%, the compression strength of the flame reaction material 3 after being subjected to the durability test decreases sharply. Further, in cases where the blending proportion of the low-fused glass frit with respect to the ternary material is higher than 60%, the formed flame color changes from a crimson-red color to a crimson-red+orange color. Therefore, such that the crimson-red color, which is the flame reaction color of Li, may be obtained, the blending proportion of the low-fused glass frit with respect to the ternary material is restricted to at most 60%.

Figure 21:
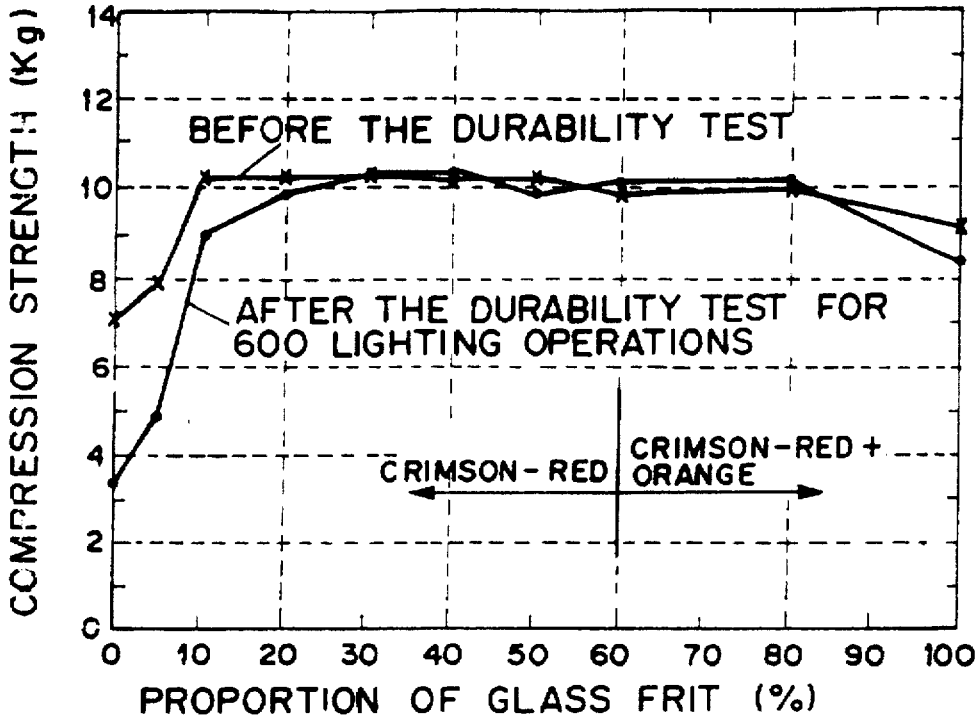
FIG. 21 is a diagram showing the relationship between a blending proportion of a glass frit with respect to the ternary material employed in Example 2 and a compression strength of the flame reaction material.

The flame color changing phenomenon described above occurs because the flame color formed by the No. 2 glass frit is a pale orange and, when the amount of the ternary material blended increases, the effects of the flame color formed by the glass frit become large. Also, as illustrated in FIG. 21, the strength of the flame reaction material 3 increases as the blending proportion of the No. 2 glass frit becomes higher. Therefore, the glass frit should preferably be added to the flame reaction material 3. However, when the blending proportion of the No. 2 glass frit is increased (to 60% or higher), the amount of $B_2O_3$ undergoing a pale green flame reaction becomes large and affects the formation of the originally desired crimson-red color. In cases where the No. 2 glass frit is added in a proportion of 30% to the composition represented by a point $P_2$ shown in FIG. 19, the overall composition is represented by $Li_2CO_3$: 28% (crimson-red), $SiO_2$: 38% (pale orange), $Al_2O_3$: 7% (orange), ZnO: 19.5% (colorless), $B_2O_3$: 7.5% (pale green). In such cases, $SiO_2$, $Al_2O_3$, and ZnO have little adverse effect upon the formation of the crimson-red color, and $B_2O_3$ undergoing a pale green flame reaction has large adverse effects upon the formation of the crimson-red color. Therefore, though the addition of the glass frit is necessary in order to enhance the strength of the flame reaction material 3, the blending proportion of the glass frit should be selected appropriately such that the formation of the crimson-red color may not be adversely affected by $B_2O_3$. In cases where the blending proportions fall within the aforesaid composition range, the flame reaction material 3, which forms the crimson-red color, can be prepared appropriately.

Figure 22:
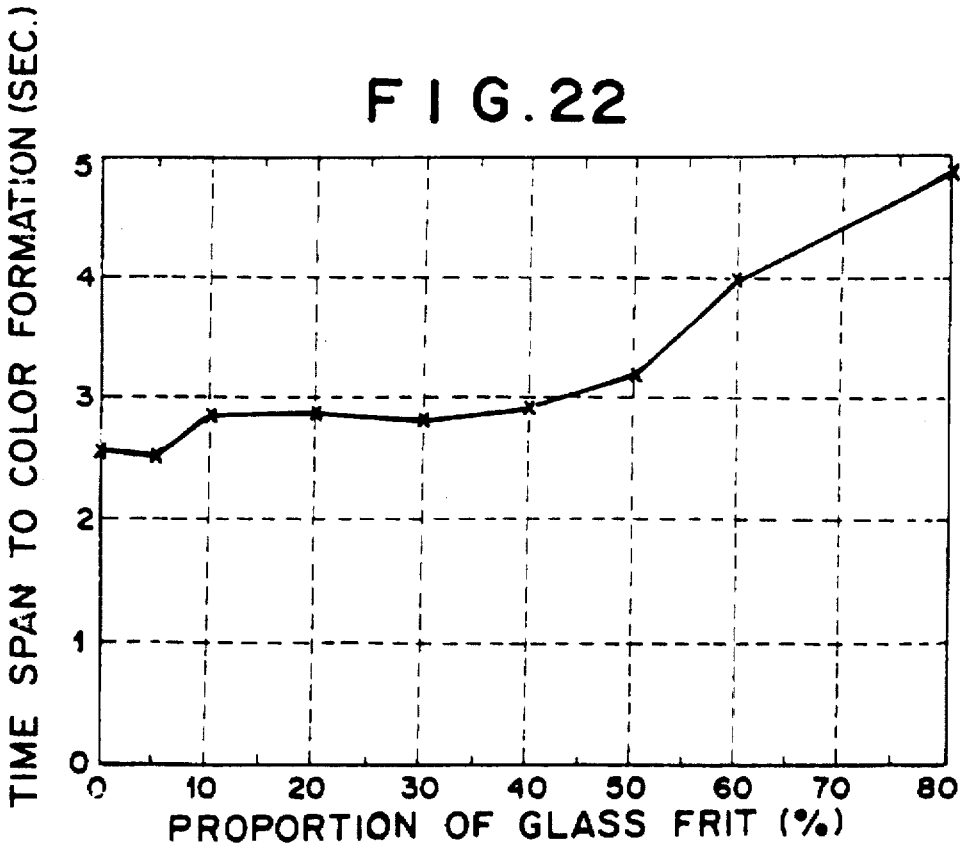
FIG. 22 is a diagram showing the relationship between the blending proportion of the glass frit with respect to the ternary material employed in Example 2 and a time span taken from lighting to color formation with the flame reaction material.

The inventors also carried out the experiments, in which the amount of the aforesaid ternary material was set to be 0.01 g, and the blending proportion of the glass frit with respect to the ternary material was changed variously. Each of the samples of the flame reaction member 1 obtained in this manner was loaded into the gas lighter 10, and the time span taken from the lighting to the color formation of the gas flame was measured. The results shown in FIG. 22 were obtained. As illustrated in FIG. 22, the time span taken from the lighting to the color formation becomes longer as the blending proportion of the glass frit with respect to the ternary material becomes higher. The blending proportion of the glass frit with respect to the ternary material should be at most 60%, and should preferably be at most 50%.

Figure 23:
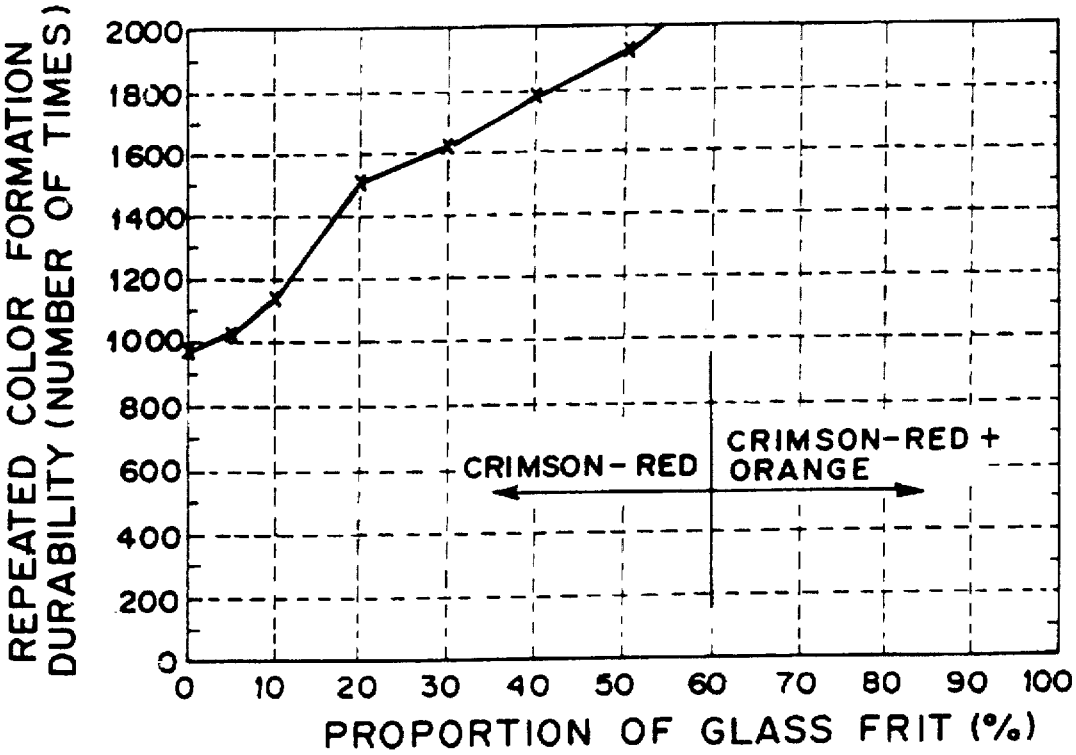
FIG. 23 is a diagram showing the relationship between the blending proportion of the glass frit with respect to the ternary material employed in Example 2 and a repeated color formation durability of the flame reaction material.

Also, in the same manner as that described above, various samples of the flame reaction member 1 were prepared by changing the blending proportion of the glass frit with respect to 0.01 g of the ternary material. Each of the samples of the flame reaction member 1 obtained in this manner was loaded into the gas lighter 10, and the repeated color formation durability, i.e. the durability life with respect to the number of times of color formations by gas lighting operations, was investigated. The results shown in FIG. 23 were obtained. As illustrated in FIG. 23, in the glass frit blending range of 0% to 60%, in which the crimson-red flame color is obtained with Li, the repeated color formation durability decreases as the blending proportion of the glass frit becomes lower.

From the results described above, the glass frit having the $SiO_2$—ZnO—$B_2O_3$ composition should preferably be blended in a proportion falling within the range of 10% to 60% by weight with respect to the $Li_2CO_3$—$SiO_2$—$Al_2O_3$ ternary material, and should more preferably be blended in a proportion falling within the range of 20% to 50% by weight with respect to the $Li_2CO_3$—$SiO_2$—$Al_2O_3$ ternary material.

A test was still further carried out, in which the composition of $Li_2CO_3$: 40%, $SiO_2$: 50%, and $Al_2O_3$: 10% was employed as the ternary material in the same manner as that described above, and each of the No. 1, No. 2, and No. 3 low-fused glass frits listed in Table 1 above was added to the ternary material in various blending proportions of 0% to 100%. Effects of the blending proportions of the glass frits upon the flame color were measured. The results shown in Table 2 below were obtained.

TABLE 2

| Proportion of glass frit | Flame color | | |
|---|---|---|---|
| | No. 1 glass frit | No. 2 glass frit | No. 3 glass frit |
| 0% | Crimson-red | Crimson-red | Crimson-red |
| 5% | Crimson-red | Crimson-red | Crimson-red + orange |
| 10% | Crimson-red + rose | Crimson-red | Crimson-red + orange |
| 20% | Crimson-red + rose | Crimson-red | Orange |
| 30% | Crimson-red + rose | Crimson-red | Orange |
| 40% | Crimson-red + rose | Crimson-red | Orange |
| 50% | Crimson-red + rose | Crimson-red | Orange |
| 60% | Rose | Crimson-red | Orange |
| 80% | Rose + pale violet | Crimson-red + orange | Orange |
| 100% | Pale violet | Pale orange | Orange |

As shown in Table 2, the blending proportions of the No. 1, No. 2, and No. 3 glass frits had the effects described below upon the formation of the crimson-red color by the $Li_2CO_3$ flame reaction agent. Specifically, as for the No. 1 glass frit (undergoing a pale violet flame reaction), the flame color changed to a crimson-red+rose color with a blending proportion of 10%, changed to a rose with a blending proportion of 60%, and changed to a rose+pale violet color with a blending proportion of 80%. As for the No. 2 glass frit (undergoing a pale orange flame reaction), the flame color was a crimson-red color with a blending proportion of up to 60%, and changed to a crimson-red+orange color with a blending proportion of 80%. As for the No. 3 glass frit (undergoing an orange flame reaction), the flame color changed to a crimson-red+orange color with a blending proportion of 5%, and changed to an orange with a blending proportion of 20%.

From the results described above, with respect to the aforesaid ternary material, the No. 2 glass frit should preferably be selected, which enables it to keep the crimson-red flame color even when the blending proportion of the glass frit is increased up to 60%. By the addition of the glass frit, the strength and the durability of the flame reaction material 3 can be enhanced. However, it often occurs that the other glass frits are preferable, depending upon the gas combustion appliances used.

EXAMPLE 3

As in Example 2, the flame reaction member 1 employed in this example was constituted to basically form a crimson-red color. However, with the flame reaction member 1 employed in this example, the flame color could be changed from orange to the crimson-red color in accordance with the blending proportions. The composition employed in this example was the same as that in Example 2, except that silica $SiO_2$ employed as a portion of the fused material in Example 2 was replaced by zirconium oxide $ZrO_2$.

Specifically, in this example, the metal element capable of undergoing a flame reaction was Li. As a primary flame reaction agent, lithium carbonate $Li_2CO_3$ was employed. Also, as a subsidiary flame reaction agent, zirconium oxide $ZrO_2$ was used. As a portion of the fused material for forming a glass compound, aluminum oxide $Al_2O_3$ and zirconium oxide $ZrO_2$ were selected. These constituents were mixed together in proportions falling within a predetermined range (which will be described later), and an $Li_2CO_3$—$ZrO_2$—$Al_2O_3$ ternary material was thereby obtained. Also, as a low-fused glass material serving as the fused material, the No. 2 glass frit was selected as in Example 2.

The flame reaction material 3 employed in this example formed a more crimson-red color than in Example 2. Also, in the region in which the blending proportion of $ZrO_2$ was increased or in the region in which the blending proportion of $Li_2CO_3$ was reduced, an orange flame color was originally formed and thereafter changed to a crimson after the passage of a predetermined number of times of use as will be described later.

Specifically, as the flame reaction member 1 to be incorporated into the aforesaid gas lighter 10, 0.56 g of $Li_2CO_3$, 0.07 g of $ZrO_2$, and 0.07 g of $Al_2O_3$ were mixed together, and 0.4 g of the No. 2 glass frit described above was mixed with the resulting mixture. Thereafter, 1.5 g of the 5% aqueous solution of the polyvinyl alcohol serving as the binder was added to the mixed powder having thus been obtained, and the resulting mixture was stirred to form the viscous liquid-like mixed material. The viscous liquid-like mixed material was applied to the coiled portion 2*a* of the substrate 2 shown in FIG. 1A. Thereafter, in the same manner as that in Example 1, the viscous liquid-like mixed material having been applied to the coiled portion 2*a* was dried at normal temperatures and then subjected to heat treatment at 300° C. for 15 minutes and heat treatment at 800° C. for 30 minutes.

Figure 24:
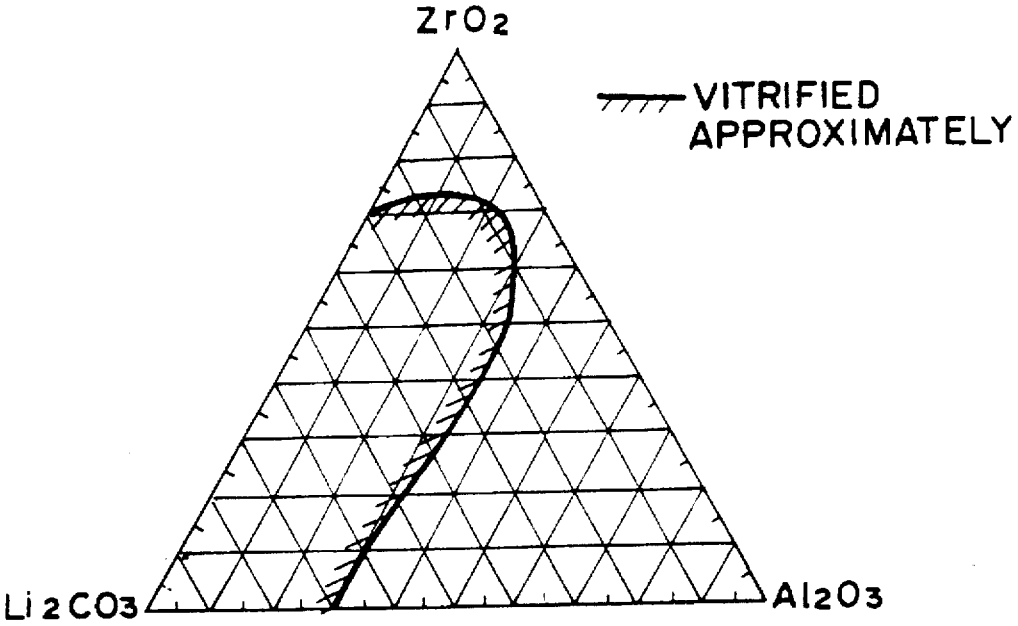
FIG. 24 is a diagram showing the relationship between blending proportions in a ternary material employed in Example 3 and a vitrification range of the ternary material.
Figure 25:
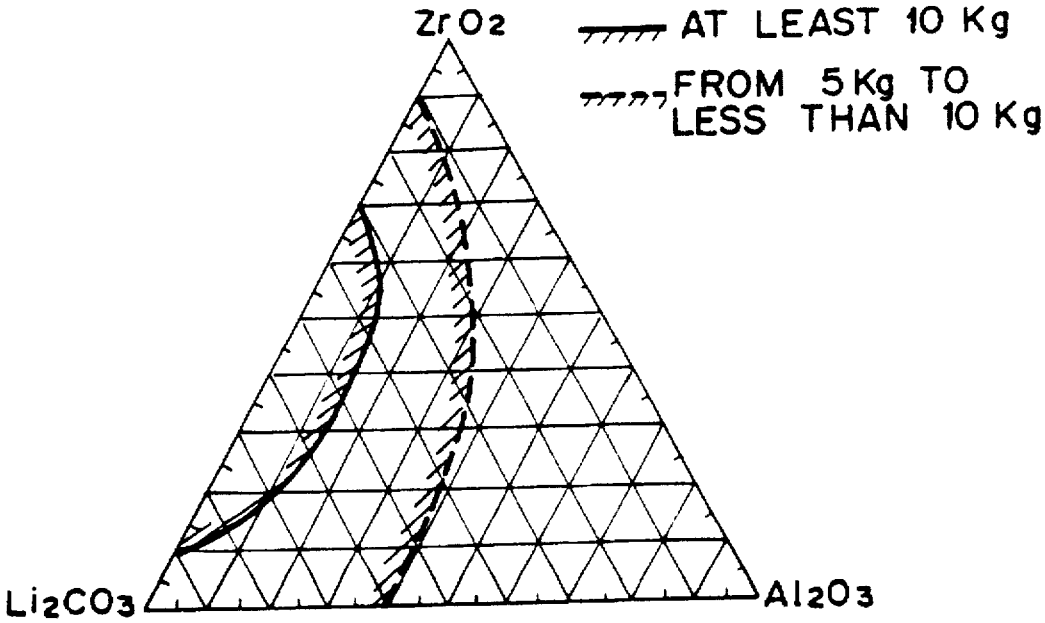
FIG. 25 is a diagram showing the relationship between the blending proportions in the ternary material employed in Example 3 and a compression strength of the ternary material.
Figure 26:
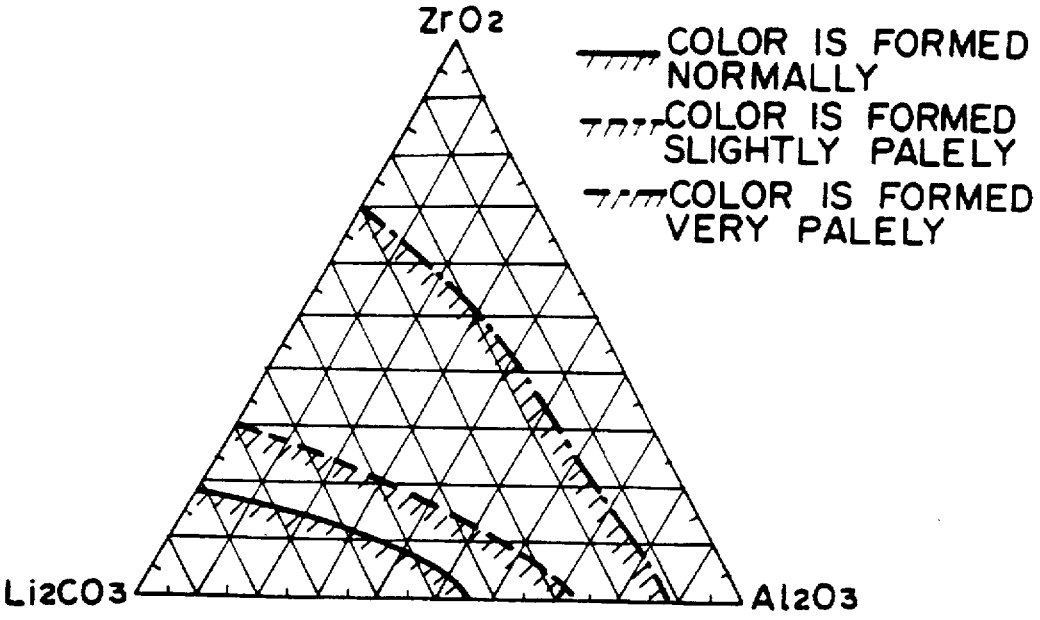
FIG. 26 is a diagram showing the relationship between the blending proportions in the ternary material employed in Example 3 and color forming characteristics of the ternary material.
Figure 27:
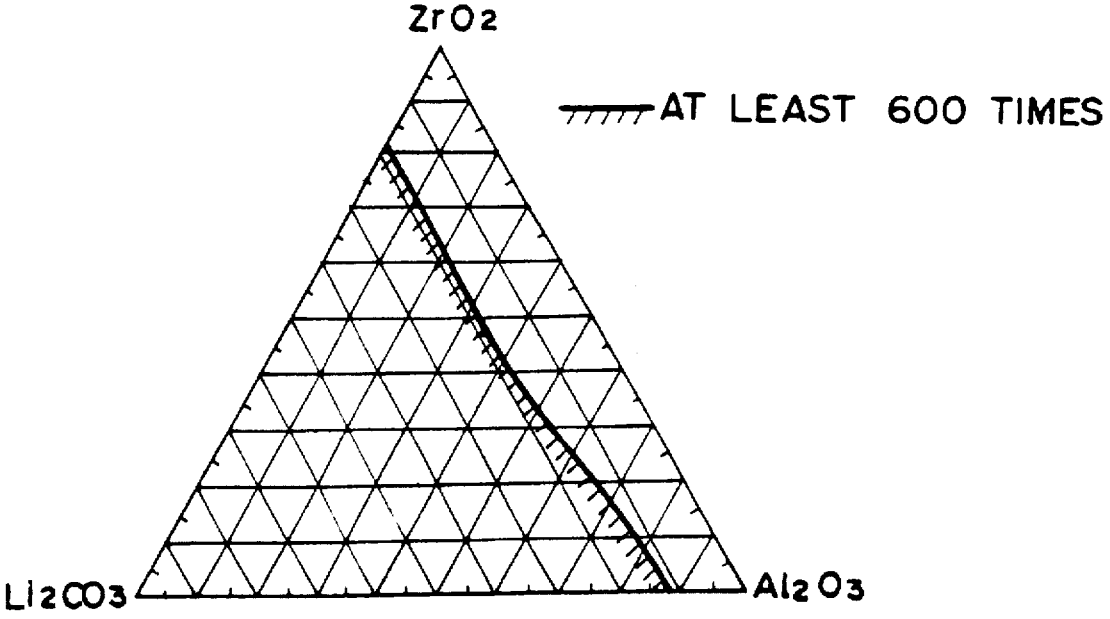
FIG. 27 is a diagram showing the relationship between the blending proportions in the ternary material employed in Example 3 and durability of the ternary material.
Figure 28:
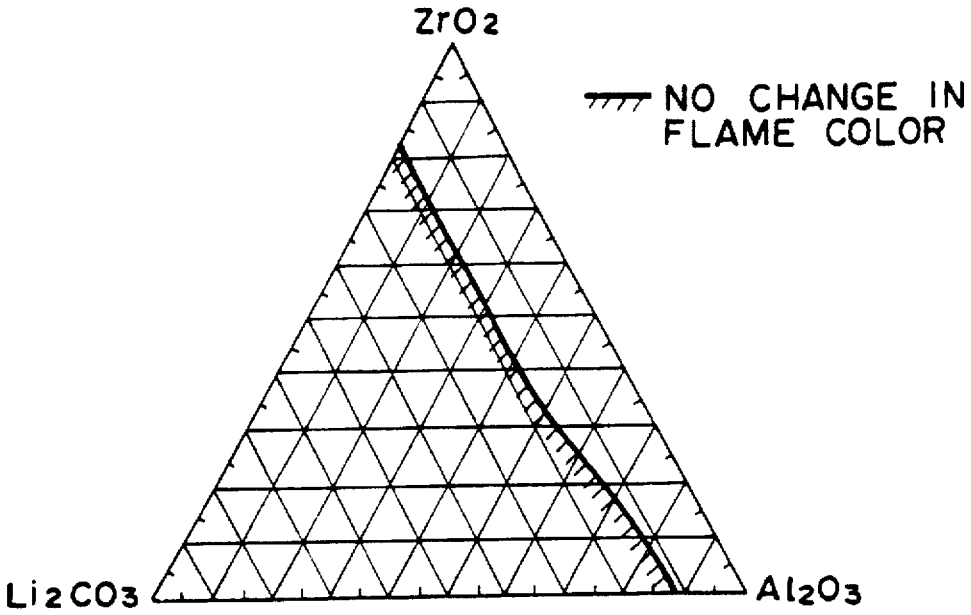
FIG. 28 is a diagram showing the relationship between the blending proportions in the ternary material employed in Example 3 and results of a continuous lighting test carried out on the ternary material.
Figure 29:
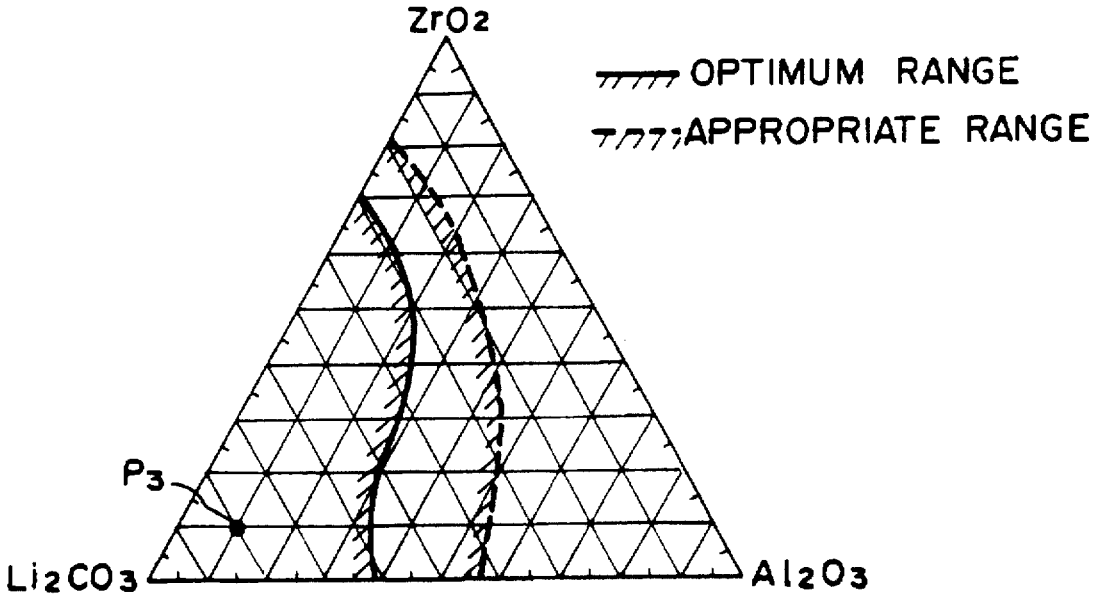
FIG. 29 is a diagram showing an appropriate blending range in the ternary material employed in Example 3.
Figure 30:
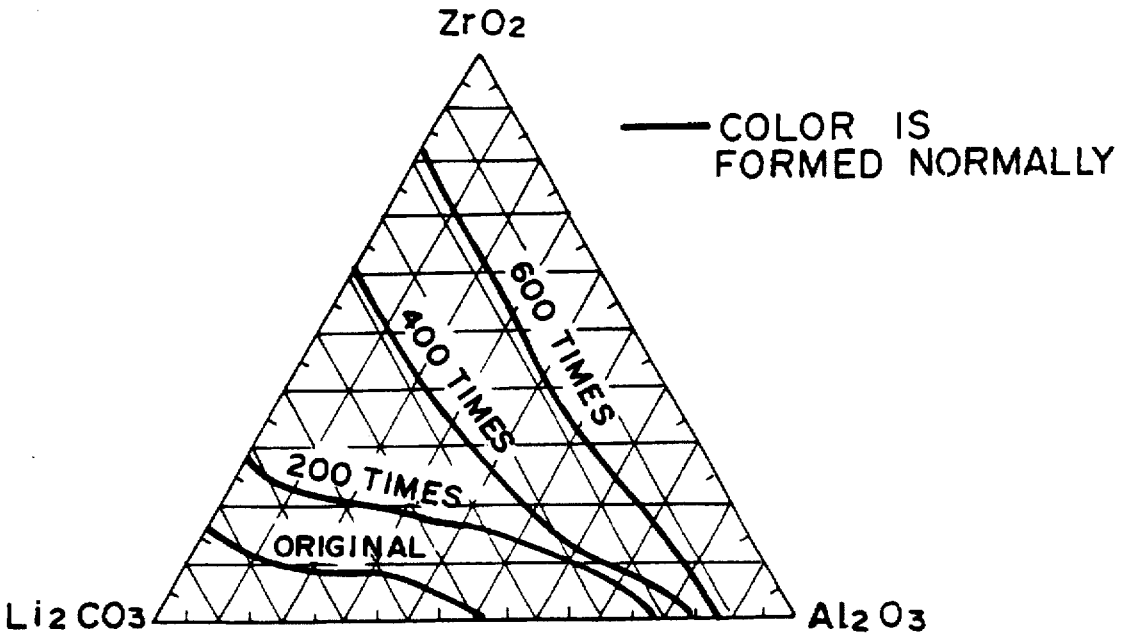
FIG. 30 is a diagram showing the relationship between the blending proportions in the ternary material employed in Example 3 and a color formation changing region of the ternary material.

As for the crimson-red flame reaction material 3, the tests were carried out in the same manner as that in Example 1 in order to determine an appropriate range of the blending proportions in the ternary material. As for the vitrification range, the results of the test shown in FIG. 24 were obtained. As for the compression strength, the results of the test shown in FIG. 25 were obtained. As for the color formation range, the results of the test shown in FIG. 26 were obtained. As for the durability test for 600 lighting operations, the results shown in FIG. 27 were obtained. As for the 30-second continuous lighting test, the results shown in FIG. 28 were obtained. FIG. 29 shows the composition range, which is appropriate as a whole, and the composition range, which is optimum as a whole. FIG. 30 shows how the normal color formation range expands with an increase in the number of lighting operations, accompanying a change of the flame color from orange to a crimson. Approximately the same effects of the blending proportion of the glass frit as those in Example 1 were obtained. From these results, typically, the composition of $Li_2CO_3$: 80%, $ZrO_2$: 10%, and $Al_2O_3$: 10% should preferably was employed. This composition coincided with a point $P_3$ shown, in FIG. 29. To this composition, the No. 2 low-fused glass frit should preferably added in a proportion of 30%, and the crimson-red flame reaction material should thereby be obtained.

EXAMPLE 4

In this example, the flame reaction member 1 was constituted to form a blue-green flame color as in Example 1. However, in this example, no glass frit was added as the fused material. As the flame reaction agent, copper oxide CuO was employed. As the fused material for forming a stable glass compound containing the flame reaction agent, boron oxide $B_2O_3$ and aluminum oxide $Al_2O_3$ were selected. These constituents were mixed together in proportions falling within a predetermined range, and a CuO—$B_2O_3$—$Al_2O_3$ ternary material was thereby obtained. The same treatment as that in Example 1 was carried out, and the flame reaction member 1 was thereby obtained.

Good results were obtained with the mixed material having the composition of CuO: 20%, $B_2O_3$: 70%, and $Al_2O_3$: 10%.

EXAMPLE 5

In this example, the flame reaction member 1 was constituted to form a crimson-red flame color as in Example 2. However, in this example, as the fused material, only the glass frit was employed. As the flame reaction agent, lithium carbonate $Li_2CO_3$ was employed. As the fused material for forming a glass compound, the No. 2 glass frit having the $SiO_2$—ZnO—$B_2O_3$ composition was added in a proportion of, for example, 30%. A mixed material was thus obtained. The same treatment as that in the previous examples was carried out, and the flame reaction member 1 was thereby obtained.

The flame reaction material of this example was vitrified approximately, had a compression strength of 6.8 kg, and normally formed the flame color. Also, no change in the flame color was observed in the durability test for 600 lighting operations and the continuous lighting test. Thus, good results were obtained.

In each of Examples 1 through 5, the substrate 2 was constituted of the wire material having the coiled portion 2*a*. Alternatively, a substrate having a generally coiled shape or a rod-like shape may be employed. Also, the substrate may be formed by molding a ceramic material. Thus various types of substrates may be used.

Also, instead of the flame reaction member being constituted by fusion bonding the flame reaction material to the substrate, the flame reaction member may be constituted by baking the flame reaction material in, for example, granular shapes. The granular flame reaction material may be accommodated in a holder. The holder may be located at the part coming into contact with the gas flame, and the gas flame may thereby be colored.

What is claimed is:

1. A gas combustion appliance comprising a fuel storage tank, a combustion cylinder, a nozzle for jetting fuel from the fuel storage tank into the combustion cylinder, an igniter for igniting fuel gas jetted into the combustion cylinder, and a flame reaction member comprising a flame reaction material disposed with the combustion cylinder so as to be heated by a gas flame within the combustion cylinder so as to produce a flame reaction which colors the gas flame by the flame reaction, wherein the flame reaction material comprises a glass compound, which is formed by mixing a flame reaction agent and a fused material with each other and fusing them together, said flame reaction agent comprising a metal compound capable of producing the flame reaction, said fused material being capable of being mixed and fused together with said flame reaction agent and vitrified.

2. A gas combustion appliance as defined in claim 1 wherein said fused material comprises a mixture of a material which has a material composition different from the material composition of said flame reaction agent, and a low-fused glass material.

3. A gas combustion appliance as defined in claim 1 wherein said fused material comprises only a material which has a material composition different from the material composition of said flame reaction agent.

4. A gas combustion appliance as defined in claim 1 wherein said fused material is constituted of only a low-fused glass material.

5. A gas combustion appliance as defined in claim 2 or 3 wherein said fused material contains at least one substance selected from the group consisting of $B_2O_3$, $Al_2O_3$, $SiO_2$, and $ZrO_2$.

6. A gas combustion appliance as defined in claim 1 wherein said flame reaction material is fusion bonded to a substrate.

7. A gas combustion appliance comprising a fuel storage tank, a combustion cylinder, a nozzle for jetting fuel from the fuel storage tank into the combustion cylinder, an igniter for igniting fuel gas jetted into the combustion cylinder, and a flame reaction member comprising a flame reaction material disposed within the combustion cylinder, so as to be heated by a gas flame within the combustion cylinder so as to produce a flame reaction which gives a blue-green color to the gas flame by the flame reaction, wherein the flame reaction material comprises a compound, which is formed by mixing a flame reaction agent and a fused material with each other and fusing them together, said flame reaction agent comprising CuO, said fused material containing $B_2O_3$ and low-fused glass material, which are capable of being mixed and fused together with said flame reaction agent and vitrified.

8. A gas lighter as defined in claim 7 wherein said fused material further contains $Al_2O_3$.

9. A flame reaction member as defined in claim 8 comprising from 10% to 65% CuO, from 20% to 90% $B_2O_3$ and from 0% to 30% $Al_2O_3$.

10. A gas combustion appliance as defined in claim 7 wherein said flame reaction material is fusion bonded to a substrate.

11. A flame reaction member for gas combustion appliances comprising a flame reaction material which is to be heated by a gas flame having been produced by a gas combustion appliance and which undergoes a flame reaction and gives a blue-green color to the gas flame by the flame reaction, wherein the flame reaction material comprises a compound which is formed by mixing a flame reaction agent and a fused material with each other and fusing them together, said flame reaction agent comprising CuO, said fused material containing $B_2O_3$ and low-fused glass material, which are capable of being mixed and fused together with said flame reaction agent and vitrified, wherein said low-fused glass material comprises $SiO_2$, $B_2O_3$ and ZnO.

12. A flame reaction member as defined in claim 11 wherein said low-fused glass material comprises 10% of $SiO_2$, 25% of $B_2O_3$, and 65% of ZnO.

13. A flame reaction member for gas combustion appliances, comprising a flame reaction material, which is to be heated by a gas flame having been produced by a gas combustion appliance and which undergoes a flame reaction and gives a crimson-red color to the gas flame by the flame reaction, wherein the flame reaction material comprises a compound, which is formed by mixing a flame reaction agent and a fused material with each other and fusing them together, said flame reaction agent comprising $Li_2CO_3$, said fused material containing $SiO_2$ and a low-fused glass material, which are capable of being mixed and fused together with said flame reaction agent and vitrified.

14. A flame reaction member as defined in claim 13 wherein said fused material further contains $Al_2O_3$.

15. A flame reaction member as defined in claim 14 wherein said low-fused glass material is contained in a proportion falling within the range of 10% to 60% by weight with respect to the $Li_2CO_3$—$SiO_2$—$Al_2O_3$ ternary material.

16. A flame reaction member as defined in claim 14 comprising 25% to 60% $Li_2CO_3$, from 20% to 75% $SiO_2$, and from 0% to 40% $Al_2O_3$.

17. A flame reaction member as defined in claim 13 wherein said low-fused glass material comprises $SiO_2$, $B_2O_3$ and ZnO.

18. A flame reaction member as defined in claim 17 wherein said low-fused glass material comprises 10% of $SiO_2$, 25% of $B_2O_3$ and 65% ZnO.

19. A flame reaction member as defined in claim 13 wherein said flame reaction material is fusion bonded to a substrate.

20. A flame reaction member for gas combustion appliances comprising a flame reaction material which is to be heated by a gas flame having been produced by a gas combustion appliance and which undergoes a flame reaction and which colors the gas flame by the flame reaction, wherein the flame reaction material comprises a glass compound, which is formed by mixing a flame reaction agent and a fused material with each other and fusing them together said flame reaction agent comprising of a metal compound capable of producing the flame reaction, said fused material being capable of being mixed and fused together with said flame reaction agent and vitrified, and wherein said fused material comprises a mixture of a material which has a material composition different from the material composition of said flame reaction agent and a low-fused glass material and wherein said low-fused glass material comprises $SiO_2$, $B_2O_3$, and $ZnO_2$.

21. A process for producing a gas combustion appliance comprising a fuel storage tank a combustion cylinder, a nozzle for jetting fuel from the fuel storage tank into the combustion cylinder, an igniter for igniting fuel gas jetted into the combustion cylinder, and a flame reaction member comprising the steps of:

i) mixing a flame reaction agent and a fused material with each other, said flame reaction agent a metal compound capable of undergoing a flame reaction, said fused material being comprising material capable of being mixed and fused together with said flame reaction agent and vitrified, ii) processing the resulting mixture in order to obtain a viscous liquid-like mixed material, iii) applying said viscous liquid-like mixed material onto a substrate, iv) heating said mixed material, which has been applied onto said substrate, to a temperature equal to at least a melting point of said mixed material, a flame reaction material, which comprises the resulting molten glass compound, being thereby fusion bonded to said substrate and mounting the substrate containing the flame reaction material within the combustion cylinder so as to be heated by a gas flame to produce a flame reaction which colors the gas flame by the flame reaction.

22. A flame reaction member for gas combustion appliances comprising a flame reaction material which is to be heated by a gas flame having been produced by a gas combustion appliance and which undergoes a flame reaction and gives a blue-green color to the gas flame by the flame reaction, wherein the flame reaction material comprises a compound which is formed by mixing a flame reaction agent and a fused material with each other and fusing them together, said flame reaction agent comprising CuO, said fused material containing $B_2O_3$ and low-fused glass material, which are capable of being mixed and fused together with said flame reaction agent and vitrified.

wherein fused material further contains $Al_2O_3$, and wherein said low-fused glass material is contained in a proportion falling within the range of 20% to 40% by weight with respect to the CuO—$B_2O_3$—$Al_2O_3$ ternary material.

23. A process for producing a flame reaction member for gas combustion appliances, comprising the steps of:

i) mixing a flame reaction agent and a fused material with each other, said flame reaction agent comprising CuO, said fused material containing $B_2O_3$ and a low-fused glass material, which are capable of being mixed and fused together with said flame reaction agent and vitrified, ii) processing the resulting mixture in order to obtain a viscous liquid-like mixed material, iii) applying said viscous liquid-like mixed material onto a substrate, and iv) heating said mixed material, which has been applied onto said substrate, to a temperature equal to at least a melting point of said mixed material, a flame reaction material, which comprises the resulting molten compound, being thereby fusion bonded to said substrate.

24. A process for producing a flame reaction member for gas combustion appliances, comprising the steps of:

i) mixing a flame reaction agent and a fused material with each other, said flame reaction agent comprising $Li_2O_3$, said fused material containing $SiO_2$ and a low-fused glass material, which are capable of being mixed and fused together with said flame reaction agent and vitrified;

ii) processing the resulting mixture in order to obtain a viscous liquid-like mixed material, iii) applying said viscous liquid-like mixed material onto a substrate, and iv) heating said mixed material, which has been applied onto said substrate, to a temperature equal to at least a melting point of said mixed material, a flame reaction material, which comprises the resulting molten compound, being thereby fusion bonded to said substrate.

* * * * *